United States Patent [19]

Sakanoue et al.

[11] Patent Number: 4,959,299

[45] Date of Patent: Sep. 25, 1990

[54] SILVER HALIDE COLOR PHOTOGRAPHIC MATERIALS

[75] Inventors: Kei Sakanoue; Hidetoshi Kobayashi; Seiji Ichijima; Shinji Ueda, all of Kanagawa, Japan

[73] Assignee: Fuji Photo Film Co., Ltd., Kanagawa, Japan

[21] Appl. No.: 164,655

[22] Filed: Mar. 7, 1988

[30] Foreign Application Priority Data

Mar. 5, 1987 [JP] Japan ..... 62-50683

[51] Int. Cl.[5] ..... G03C 7/32; G03C 7/42

[52] U.S. Cl. ..... 430/544; 430/549; 430/955; 430/957; 430/393

[58] Field of Search ..... 430/544, 543, 549, 550, 430/553, 555, 557, 558, 559, 957, 958, 545, 955, 430, 393

[56] References Cited

U.S. PATENT DOCUMENTS 4,409,323 10/1983 Sato et al. ..... 430/544
4,842,994 6/1989 Sakanoue et al. ..... 430/430

FOREIGN PATENT DOCUMENTS 0193389 9/1986 European Pat. Off. .
2010818 7/1979 United Kingdom .
2072363 9/1981 United Kingdom .
2096783 10/1982 United Kingdom .

OTHER PUBLICATIONS

"Bleach Accelerator . . . ", *Research Disclosure,* No. 11449, 10/1973.
"Compounds Capable . . . Moiety", *Research Disclosure,* No. 24241, 6/1984, pp. 286–292.

*Primary Examiner*—Richard L. Schilling
*Attorney, Agent, or Firm*—Sughrue, Mion, Zinn, Macpeak & Seas

[57] ABSTRACT

A silver halide color photographic material is disclosed comprising at least one silver halide emulsion layer on a support, wherein at least one type of development inhibitor releasing type coupler is present which, by means of a coupling reaction with the oxidized form of a primary aromatic amine developing agent, releases a precursor of a compound, the precursor inhibiting the development of silver halide which subsequently, by means of an electron transfer reaction via an ethylenic conjugated chain, releases a compound which inhibits the development of silver halide, and at least one type of bleach accelerating agent releasing type coupler is present which, by means of a coupling reaction with the oxidized form of primary aromatic amine developing agent, releases a bleach accelerating agent or a precursor thereof.

8 Claims, No Drawings

SILVER HALIDE COLOR PHOTOGRAPHIC MATERIALS

FIELD OF THE INVENTION

This invention concerns silver halide color photographic materials and the processing characteristics thereof, and mover precisely it concerns photosensitive materials and methods of processing which provide excellent sharpness and a shorter bleaching time.

BACKGROUND OF THE INVENTION

Technological progress has been made with the latest color photographic materials and processing methods with a view to improving picture quality and to simplifying and speeding up processing as in the case of mini-laboratories.

In connection with the improvement of picture quality, the importance of the so-called DIR couplers as disclosed in U.S. Pat. Nos. 3,227,554, 3,701,783, 3,615,506, and 3,617,291, etc., for improving sharpness is well known. Thus a high degree of sharpness is obtained when DIR couplers containing timing groups as disclosed in Japanese Patent Application (OPI) No. 145,135/79 (the term "OPI" refers to an "unexamined Japanese patent application which has been opened for public inspection" are used, but there are problems with the stability, etc., of these compounds and they cannot be said to be ideal.

Furthermore the timing type DIR couplers disclosed in Japanese Patent Application (OPI) Nos. 114,946/81 (corresponding to U.S. Pat. No. 4,409,323), 98,728/83, 209,738/83, 209,739/83 and 209,740/83 are better with respect to the weakness mentioned above, but when they are used the de-silvering operation during processing is slow and it is clear that sufficient time must be allowed for de-silvering especially in the case of an oxidation process for reduced silver using a bleach.

On the other hand the use of bleach acceleration agent releasing type couplers in silver halide color photographic materials has been disclosed in *Research Disclosure,* 1973, Item No. 11449 and in Japanese Patent Application (OPI) No. 201,247/86 (corresponding to U.S. patent application Ser. No. 707,115).

The bleach accelerating agents which are formed by the eliminated groups of these bleach accelerating agent releasing type couplers have some effect under conditions where the developer bath has not yet been used, but there is some deterioration of the bleach accelerating effect under normal running conditions where developer, etc., is carried over into the bleach bath or bleach-fix bath.

Hence the development of a novel method which enables the de-silvering process time to be shortened even under normal running conditions when processing photosensitive materials of which the sharpness has been improved using DIR couplers is clearly desirable.

SUMMARY OF THE INVENTION

Hence the first aim of the invention is to provide color photographic materials which have a high level of sharpness and with which the de-silvering process can be executed in a short period of time.

The second aim of the invention is to provide silver halide color photographic materials in which timing type DIR couplers are used and which have excellent de-silvering properties even under running conditions.

The problems mentioned above are overcome by the present invention indicated below:

A silver halide color photographic material comprising at least one silver halide emulsion layer on a support and containing at least one type of development inhibitor releasing type coupler which, by means of a coupling reaction with the oxidized form of a primary aromatic amine developing agent, releases a precursor of a compound, the precursor inhibiting the development of silver halide which subsequently, by means of an electron transfer reaction via an ethylenic conjugated chain, releases a compound which inhibits the development of silver halide, and at least one type of bleach accelerating agent releasing type coupler which, by means of a coupling reaction with the oxidized form of a primary aromatic amine developing agent, release a bleach accelerating agent or a precursor thereof.

DETAILED DESCRIPTION OF THE INVENTION

In the silver halide color photographic material of this invention the aforementioned bleach accelerating agent releasing type coupler can be represented by the general formula [I], [II], [III] or [IV] are shown below.

General Formula [I]

$A—(Time)_n—S—R_1—R_2$

General Formula [II]

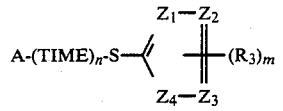

General Formula [III]

$A—(Time)_n—S—R_4(R_3)_m$

General Formula [IV]

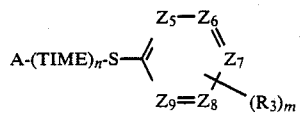

In these general formulae [I]-[IV] A represents the coupler residual group, TIME represents a timing group, n is an integer of value 0 or 1, $Z_1$, $Z_2$ and $Z_3$ each independently represent a nitrogen atom or a methine group, $Z_4$ represents an oxygen atom, sulfur atom or an imino group, $Z_5$, $Z_6$, $Z_7$, $Z_8$ and $Z_9$ each independently represent a nitrogen atom or a methine group (except that at least one of $Z_5$, $Z_6$, $Z_7$, $Z_8$ and $Z_9$ represents a nitrogen atom), $R_1$ represents a divalent aliphatic group which has from 1 to 8 carbon atoms (but excluding alicyclic groups or an aromatic group which has from 6 to 10 carbon atoms, $R_2$ represents a water soluble substituent group, $R_3$ represents a water soluble substituent group, m is an integer from 0 to 2 and $R_4$ is an alicyclic group which has from 3 to 10 carbon atoms or a saturated heterocyclic group which has from 3 to 10 carbon atoms.

In this invention, the aliphatic groups may be saturated or unsaturated, substituted or unsubstituted and they may have linear chains, branched chains. Typical examples include a methyl group, an ethyl group, a butyl group, an allyl group, a propargyl group, a methoxyethyl group, a n-decyl group, a n-dodecyl group, a n-hexadecyl group, a trifluoromethyl group, a heptafluoropropyl group, a dodecyloxypropyl group, a 2,4-di-tert-amylphenoxypropyl group, a 2,4-di-tert-amylphenoxybutyl group etc.

Furthermore, the alicyclic groups may be saturated or unsaturated and may be substituted or unsubstituted. A typical examples includes a cyclohexyl group.

Furthermore, the aromatic groups may also be either substituted or unsubstituted groups and typical examples include a phenyl group, a tolyl group, a 2-tetradecyloxyphenyl group, a pentafluorophenyl group, a 2-chloro-5-dodecyloxycarbonylphenyl group, a 4-chlorophenyl group, a 4-cyanophenyl group, a 4-hydroxyphenyl group, etc.

Furthermore, the heterocyclic groups may also be either substituted or unsubstituted groups and typical examples include a 2-pyridyl group, a 4-pyridyl group, a 2-furyl group, a 4-thienyl group, a quinolinyl group, etc.

The development inhibitor releasing type couplers which release by means of a coupling reaction with the oxidized form of a primary aromatic amine developing agent the precursors of compounds which inhibit the development of the silver halide and the precursors subsequently by means of an intramolecular electron transfer reaction via an ethylenic conjugated chain release compounds which inhibit the development of the silver halide which are used in the present invention are described in detail below.

The development inhibitor releasing type couplers used in the present invention can be represented by the general formula [V] shown below.

General Formula [V]

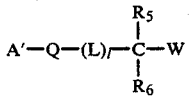

In this formula A' represents a coupler residual group which release the remaining section of the molecule including Q on undergoing a coupling reaction with the oxidized form of a primary aromatic amine developing agent, Q represents an oxygen atom, sulfur atom or a substituted imino group, L represents a vinylene group, l is an integer of value 1 or 2, $R_5$ and $R_6$ each independently represent a hydrogen atom, an alkyl group or an aryl group and W represents a component (compound) which inhibits the development of silver halide. Furthermore, when l is 2 the two vinylene groups may be the same or different. The vinylene groups represented by L are preferably structural elements of a benzene ring or a heterocyclic ring.

Furthermore, when Q represents a substituted imino group the substituent is preferably linked with L and forms together with the nitrogen atom and L a five to seven membered nitrogen-containing ring.

Moreover, of the compounds which can be represented by the general formula [V] those which can be represented by the general formulae [VI]–[IX] shown below are preferred.

General Formula [VI]

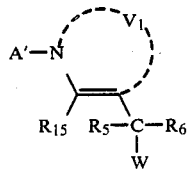

General Formula [VII]

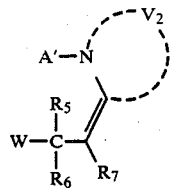

General Formula [VIII]

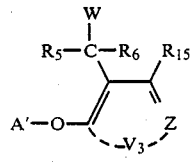

General Formula [IX]

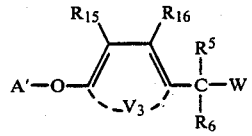

In the general formula [V] to [IX], A', $R_5$, $R_6$ and W have the same significance as A', $R_5$, $R_6$ and W in general formula [V] and $V_1$ and $V_2$ represent the non-metallic atomic groups which are required to form, along with the linked atomic groups, a five to seven membered nitrogen-containing heterocyclic ring (which may have substituents or which may take the form of a condensed ring system) and $V_3$ represents the non-metallic atomic group which is required to form, along with the linked atomic groups, a five to seven membered heterocyclic ring (which may have substituents or which may take the form of a condensed ring system) or a benzene ring (which may have substituents or which may take the form of a condensed ring system), Z represents a substituted or unsubstituted methine group or a nitrogen atom, $R_7$ represents a hydrogen atom or a univalent group and $R_{15}$ and $R_{16}$ each independently represent a univalent group. However $R_7$ may be linked to $V_2$ to form a ring.

A', $R_5$, $R_6$, $R_7$, $R_{15}$, $R_{16}$, Z and W in the general formulae [V]–[IX] are described in detail below. The coupler residual group which is represented by A' may be a yellow image forming coupler, a magenta image forming coupler, a cyan image forming coupler or a so-called colorless coupler, such that the product of the coupling reaction is essentially colorless etc.

The yellow image forming coupler residual group which is represented by A' may, for example, be a coupler residual group of the pivaloylacetanilide type, the benzoylacetanilide type, the malonic diester type, malonic diamide type, the dibenzoylmethane type, the benzothiazolylacetamide type, the malonic ester monoamide type, the benzothiazolylacetate type, the benzoxazolylacetamide type, the benzoxazolylacetate type, the malonic diester type, the benzimidazolylacetamide type or the benzimidazolylacetate type; a coupler residual group derived from a heterocyclic substituted acetamide or a heterocyclic substituted acetate as included in U.S. Pat. No. 3,841,880, a coupler derived from the acylacetamides disclosed in U.S. Pat. No. 3,770,446, British Patent No. 1,459,171, West German Patent (OLS) No. 2,503,009, Japanese Patent Application (OPI) No. 139,738/75 and *Research Disclosure* No. 15737 or a heterocyclic type coupler residual group as disclosed in U.S. Pat. No. 4,046,574.

The magenta image forming coupler residual group represented by A' is preferably a coupler residual group which has a 5-oxo-2-pyrazoline nucleus, a pyrazolo-[1,5-a]benzimidazole nucleus, a pyrazoloimidazole nucleus, a pyrazolotriazole nucleus, a pyrazolotetrazole nucleus or a cyanoacetophenone type coupler residual group.

The cyan image forming coupler residual group represented by A' is preferably a coupler residual group which has a phenol nucleus or an α-naphthol nucleus.

Moreover, couplers which couple with the oxidized form of the developing agent and release a development inhibitor, but which in essence do not subsequently form a dye have the same effect as a DIR coupler. Examples of coupler residual groups of this type which can be represented by A' include those which are disclosed in U.S. Pat. Nos. 4,052,213, 4,088,491, 3,632,345, 3,958,993 and 3,961,959.

Examples of the preferred coupler residual groups which can be represented by A' are represented by the general formulae (Cp-1)–(Cp-9) which will be described later.

$R_5$ and $R_6$ each independently represent a hydrogen atom, an alkyl group which has from 1 to 36 carbon atoms (for example, a methyl group, an ethyl group, a benzyl group, a dodecyl group, a cyclohexyl group, etc.) or an aryl group which has from 6 to 36 carbon atoms (for example, a phenyl group, a 4-methoxyphenyl group, a 4-chlorophenyl group, a 4-nitrophenyl group, a naphthyl group, etc.), but they preferably represent hydrogen atoms.

$R_7$ represents a group which can link with $V_2$ and the groups indicated by $R_5$ and $R_6$ to form a benzene ring or a five to seven membered heterocyclic ring (for example a pyrrole, a pyrazole, a 1,2,3-triazole, a pyridine, a pyridazine, a pyrimidine, a thiophene or furan ring, etc.)

$R_{15}$ and $R_{16}$ each independently represent a hydrogen atom, an aliphatic group which has from 1 to 30 carbon atoms (for example, a methyl group, an ethyl group, an n-undecyl group, etc.), an alicyclic group which has from 3 to 30 carbon atoms, an aromatic group which has from 6 to 30 carbon atoms (for example, a phenyl group, a p-tolyl group, a 1-naphthyl group, a p-nitrophenyl group, etc.), a halogen atom (for example a fluorine atom, a chlorine atom, a bromine atom, etc.), a substituted or unsubstituted aliphatic oxy group which has from 1 to 30 carbon atoms (for example, a methoxy group, an ethoxy group, a benzyloxy group, a dedecyloxy group, etc.), an unsubstituted or substituted amino group or cyclic imino group which has from 0 to 36 carbon atoms (for example an amino group, a dimethylamino group, a pyrrolidino group, a piperidino group, a morpholino group, an anilino group, an n-dodecylamino group, an octadecylmethylamino group, a 2-chloro-5-tetradecanamidophenylamino group, etc.), a nitro group, a cyano group, a carboxyl group, a substituted or unsubstituted carboxylamido group which has from 1 to 36 carbon atoms (for example, an acetamido group, a benzamido group, a tetradecanamido group etc.) a substituted or unsubstituted sulfonamido group which has from 1 to 36 carbon atoms (for example, a methylsulfonamido group, an n-hexadecylsulfonamido group, a p-tolylsulfonamido group, etc.), or an alkoxycarbonyl group which has from 2 to 36 carbon atoms (for example, a methoxycarbonyl group, a dodecyloxycarbonyl group, etc.). $R_{15}$ and $R_{16}$ are preferably hydrogen atoms, aliphatic group or alicyclic groups.

Z represents a substituted or unsubstituted methine group or a nitrogen atom and when Z represents a substituted methine group, the substituents may be those cited as examples of the substituents for $R_{15}$ and $R_{16}$.

W may be a triazolyl group, a tetrazoyl group, a 1,3,4-oxadiazol-2-yltho group, a 1,3,4-thiadiazol-2-ylthio group, a 1-indazolyl group, a 1-benzimidazolyl group, a 1-benzotriazolyl group, a 2-benzotrriazolyl group, a 2-benzimidazolylthio group, a 2-benzoxazolylthio group, a 2-benzothiazolylthio group, a 2-pyrimidylthio group, a 2-pyridylthio group, a 4-quinolylthio group, a 1,3,5-triazin-2-ylthio group, a 2-imidazolylthio group, a 1,2,4-triazol-5-ylthio group, a 1,3,4-triazol-2-ylthio group, a 1,2,3,4-tetrazol-5-ylthio group, etc., and these groups may have substituent groups. The preferred groups for W are 1,2,3,4-tetrazol-5-ylthio groups, 1,3,4-oxadiazol-2-ylthio groups, 1,3,4-thiadiazol-2-ylthio groups, 1-benzotriazolyl groups, 2-benzothiazolylthio groups, 2-benzoxazolylthio groups, 1,3,4-triazol-2-ylthio groups and 2-pyrimidylthio groups, and the more desirable groups are those which can be represented by the general formulae [X]–[XVII] shown below.

General Formula [X]

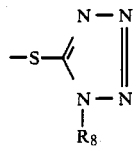

General Formula [XI]

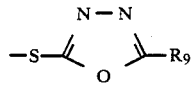

General Formula [XII]

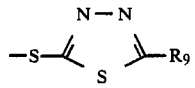

General Formula [XIII]

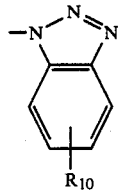

General Formula [XIV]

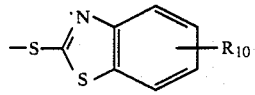

-continued

General Formula [XV]

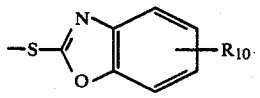

General Formula [XVI]

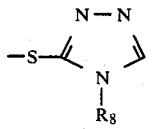

General Formula [XVII]

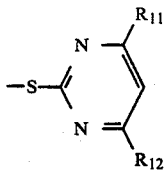

In the general formulae [X]–[XVII], $R_8$ represents a substituted or unsubstituted alkyl group which has from 1 to 16 carbon atoms (for example, a methyl group, an ethyl group, a hexyl group, a benzyl group, an octyl group, etc.) or a substituted or unsubstituted aryl group which has from 6 to 24 carbon atoms (for example, a phenyl group, a 4-hydroxyphenyl group, a 3-hydroxyphenyl group, a 3-sulfamoylphenyl group, a 3-succinimidophenyl group, a 4-methylphenyl group, a 4-methoxyphenyl group, a 3-nitrophenyl group, a 3-acetamidophenyl group, a 3-methylsulfonamidophenyl group, a 4-methoxycarbonylphenyl group, etc.).

$R_9$ represents a hydrogen atom, a halogen atom, an amino group, a substituted or unsubstituted alkyl group which has from 1 to 16 carbon atoms (for example, a methyl group, an ethyl group, a hydroxyethyl group, a methyoxyethyl group, a butyl group, etc.), a substituted or unsubstituted aryl group which has from 6 to 24 carbon atoms (for example, a phenyl group, a 4-methoxyphenyl group, a 4-chlorophenyl group, etc.), a substituted or unsubstituted carboxylamido group which has from 1 to 24 carbon atoms (for example, an acetamido group, a benzamido group, etc.), a substituted or unsubstituted alkylthio group which has from 1 to 16 carbon atoms (for example, a methylthio group, an ethylthio group, a benzylthio group, an octylthio group, a methoxycarbonylmethylthio group, etc.) a substituted or unsubstituted arylthio group which has from 6 to 24 carbon atoms (for example, a 4-acetamidophenylthio group, a 4-methylsulfonamidophenylthio group, etc.) or a substituted or unsubstituted sulfonamido group which has from 1 to 24 carbon atoms (for example, a methylsulfonamido group, a tolylsulfonamido group, an octylsulfonamido group, etc.).

$R_{10}$ represents a hydrogen atom, a halogen atom, a hydroxyl group, an alkyl group which has from 1 to 16 carbon atoms (for example, a methyl group, an ethyl group, a butyl group, etc.), a substituted or unsubstituted alkoxy group which has from 1 to 16 carbon atoms (for example, a methoxy group, an ethoxy group, a butoxy group, a methoxyethoxy group, a benzyloxy group, etc.), a nitro group, a cyano group, an amino group, a substituted or unsubstituted carboxylamido group which has from 1 to 24 carbon atoms (for example, an acetamido group, a benzamido group, etc.), a substituted or unsubstituted sulfonamido group which has from 1 to 24 carbon atoms (for example, a methylsulfonamido group, a phenylsulfonamido group, etc.), an alkoxycarbonyl group which has from 2 to 16 carbon atoms (for example, a methoxycarbonyl group, an ethoxycarbonyl group, etc.), a substituted or unsubstituted aryloxycarbonyl group which has from 6 to 16 carbon atoms (for example, a phenoxycarbonyl group, a 4-methylphenoxycarbonyl group, etc.), or a substituted or unsubstituted sulfamoyl group which has from 0 to 16 carbon atoms (for example, a sulfamoyl group, a dimethylsulfamoyl group, a butylsulfamoyl group, etc.).

$R_{11}$ and $R_{12}$ represent hydrogen atoms hydroxyl groups, amino groups, alkyl groups which have from 1 to 8 carbon atoms (for example, methyl groups, ethyl groups, etc.), or alkoxy groups which have from 1 to 8 carbon atoms (for example, methoxy groups, ethoxy groups, methoxyethoxy groups etc.).

Of the aforementioned compounds which can be represented by the general formulae [VI]–[IX], those which can be represented by the general formula [VIII] are preferred and of the compounds which can be represented by the general formula [VIII], those which can be represented by the general formula [VXIII] below are especially desirable.

General Formula [XVIII]

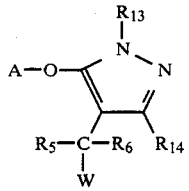

In general formula [XVIII], A', $R_5$, $R_6$, and W are the same as A', $R_5$, $R_6$ and W in the aforementioned general formula [V], $R_{13}$ represents a substituted or unsubstituted alkyl group which has from 1 to 24 carbon atoms (for example, a methyl group, a benzyl group, a dodecyl group, etc.) or a substituted or unsubstituted aryl group which has from 6 to 36 carbon atoms (for example, a phenyl group, a 4-tetradecyloxyphenyl group, a 4-methoxyphenyl group, a 4-chlorophenyl group, a 2,5-dichlorophenyl group, a 4-methylphenyl group, a 4-nitrophenyl group, etc.) and $R_{14}$ represents a hydrogen atom, an alkyl group which has from 1 to 24 carbon atoms (for example, methyl group, ethyl group, undecyl group, etc.), a substituted or unsubstituted aryl group which has from 6 to 36 carbon atoms (for example, a phenyl group, a 4-methoxyphenyl group, etc.), an alkoxy group which has from 1 to 24 carbon atoms (for example, a methoxy group, ethoxy group, dodecyloxy group, etc.), a cyano group, a substituted or unsubstituted amino group or cyclic imino group which has from 0 to 36 carbon atoms (for example, an amino group, a dimethylamino group, a piperidino group, a dihexylamino group, an anilino group, etc.), a substituted or unsubstituted carboxylamido group which has from 1 to 24 carbon atoms (for example, an acetamido group, a benzamido group, a tetradecanamino group, etc.), a substituted or unsubstituted sulfonamido group which has from 1 to 24 carbon atoms (for example, a methylsulfonamido group, a phenylsulfonamido group, etc.), a carboxyl group, an alkoxycarbonyl group which has from 2 to 24 carbon atoms (for example, a methoxycarbonyl group, dodecyloxycarbonyl group, etc.) or a substituted or unsubstituted carbamoyl group which has from 1 to 24 carbon atoms (for example, a carbamoyl group, a dimethylcarbamoyl group, a pyrrolidinecarbamoyl group, etc.).

A' in general formula [XVIII] is preferably a cyan image forming coupler residual group (for example, a phenol based cyan coupler residual group, an α-naphthol based cyan coupler residual group, etc.), $R_5$ and $R_6$ are preferably hydrogen atoms, $R_{13}$ is preferably an aryl group, $R_{14}$ is preferably an alkyl group and W is preferably a group which can be represented by the general formula [X], [XI] or [XII].

The bleach accelerating agent eliminating type couplers which can be used in the present invention are described in detail below.

The term "bleach accelerating agent eliminating type coupler" signifies a coupler which releases a bleach accelerating agent or a precursor thereof by means of a coupling reaction with the oxidized form of a primary aromatic amine developing agent and such couplers can be represented typically by the general formula [I], [II], III] or [IV].

General Formula [I]

$A—(Time)_n—S—R_1—R_2$

General Formula [II]

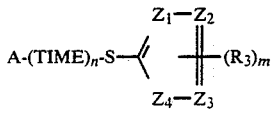

General Formula [III]

$A—(Time)_n—S—R_4(R_3)_m$

General FOrmula [IV]

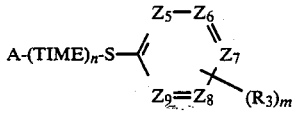

In these general formulae [I]–[IV], A represents the coupler residual group, TIME represents a timing group, n is an integer of value 0 or 1, $Z_1$, $Z_2$ and $Z_3$ each independently represent a nitrogen atom or a methine group, $Z_4$ represents, an oxygen atom, a sulfur atom, or an imino group, $Z_5$, $Z_6$, $Z_7$, $Z_8$ and $Z_9$ each independently represent a nitrogen atom or a methine group (except that at least one of $Z_5$, $Z_6$, $Z_7$, $Z_8$ and $Z_9$ represents a nitrogen atom), $R_1$ represents a divalent aliphatic group which has from 1 to 8 carbon atoms (but excluding alicylic groups) or an aromatic group which has from 6 to 10 carbon atoms, $R_2$ represents a water soluble substituent group, $R_3$ represents a water soluble substituent group, m is an integer of value from 0 to 2 and $R_4$ is an alicyclic group which has from 3 to 10 carbon atoms or a saturated heterocyclic group which has from 3 to 10 carbon atoms.

The bleach accelerating agent releasing couplers of general formulae [I]–[IV] which are preferably used in the invention are described in detail below.

In these formulae, the group represented by $R_2$ preferably has not more than 8 carbon atoms and contains at least one group from among carboxyl groups, sulfo groups, hydroxyl group, and the substituted or unsubstituted amino groups, acyl groups, alkoxy groups, acylamino groups, sulfonamido groups, sulfamoyl groups, carbamoyl groups, ureido groups, alkylthio groups or sulfonyl groups as substituent groups.

The most desirable of the substituent groups mentioned above include those which have a n-substituent constant of less than 0.5 and which is preferably negative. The n-substituent constant is the value calculated for $R_2$ using the method proposed by C. Hansch and A. Leo in "Substituent Constants for Correlation Analysis in Chemistry and Biology", published by John Wiley in 1979. Some of these values are indicated below.

$—CONH_2$ (−1.49), $—CO_2H$ (0.32), $—COCH_3$ (−0.55), $—NHCOCH_3$ (−0.97), $—CH_2CH_2CO_2H$ (−0.29), $—CH_2CH_2NH_2$ (0.08), $—SCH_2CO_2H$ (0.31),

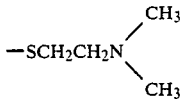

(0.43), $—CH_2CO_2H$ (0.68), $—SCH_2CONH_2$ (−0.97),

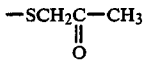

(0.43), $—SCH_2CH_2CO_2H$ (−0.01).

The aliphatic groups represented by $R_1$ in the formulae has from 1 to 8 carbon atoms and may be saturated or unsaturated, have a linear or branched chain and it may or may not have substituent groups. Typical examples of substituent groups include those indicated for the group represented by $R_2$ and halogen atoms.

When $R_1$ represents an aromatic group, it is preferably a substituted or unsubstituted phenelene. Typical examples of substituent groups include those indicated for the group indicated by $R_2$ and halogen atoms.

$R_3$ has the same significance as $R_2$ which has been described above. When m has a value of 2 the two $R_3$ groups may be the same or different or may be divalent groups which are joined together to form a ring structure. Examples of divalent groups for forming ring structures include the

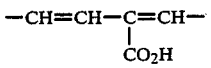

group, for example.

When $Z_1$, $Z_2$, $Z_3$, $Z_5$, $Z_6$, $Z_7$, $Z_8$ and $Z_9$ represent substituted or unsubstituted methine groups, the unsubstituted groups are preferred, but typical examples of substitutents include methyl groups, ethyl groups, halogen atoms etc.

When $Z_4$ represents a substituted or unsubstituted imino group, then aliphatic groups which have from 1 to 4 carbon atoms or phenyl groups are typical substituents.

When both $Z_2$ and $Z_3$ represents a methine group, $Z_2$ and $Z_3$ may contain a group which makes condensation ring (e.g., benzo, pyrido) at this position. An example of such $Z_2$ and $Z_3$ includes, e.g.,

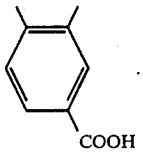

Actual examples of the $—S—R_1—R_2$ group in general formula [I] are indicated below.

$-SCH_2CH_2CO_2H$, $-SCH_2CO_2H$,

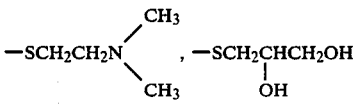

$-SCH_2CH_2NH_2$,

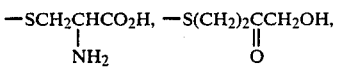

$-S-CH_2CH_2OCH_2CH_2OH$, $-SCH_2CH_2NHCOCH_3$, $-S(CH_2)_4CH_2H$,

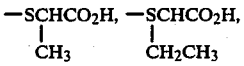

$-SCH_2CONHCH_2CO_2H$, $-SCH_2CH_2OCH_2CH_2CO_2H$, $-SCH_2COOCH_2CH_2OH$.

Actual examples of the group represented in general formula [II] by

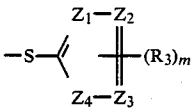

are shown below.

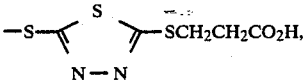

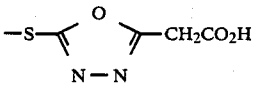

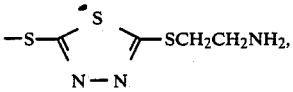

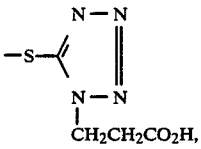

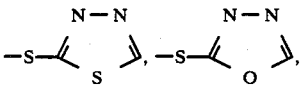

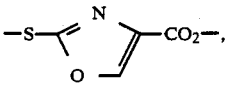

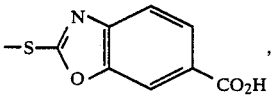

-continued

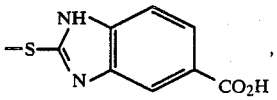

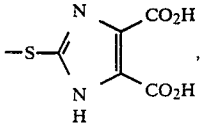

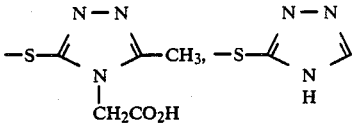

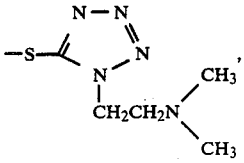

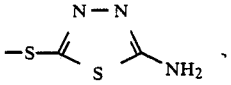

Actual examples of the group represented in general formula [III] by

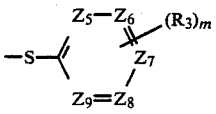

are indicated below.

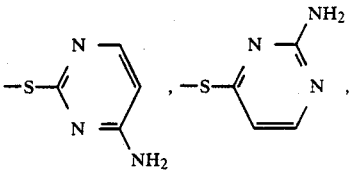

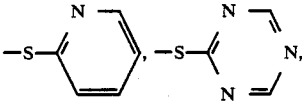

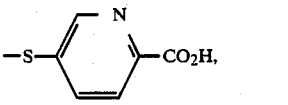

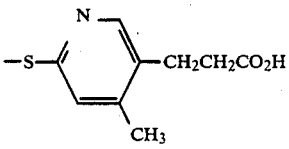

Known coupler residual groups can be used for the group represented by A. For example, A may represent a yellow coupler residual group (for example, an open chain ketomethylene type coupler residual group, etc.), a magenta coupler residual group (for example, a 5-pyrazolone type coupler residual group, a pyrazoloimidazole type coupler residual group, or a pyrazolotriazole type coupler residual group, etc.), a cyan coupler residual group (for example, a phenol type coupler residual group or a naphthol type coupler residual group, etc.) or a colorless coupler residual group (for example, an indanone type coupler residual group or an acetophenone type coupler residual group, etc.). Furthermore, it may also take the form of a heterocyclic type coupler residual group as disclosed in U.S. Pat. Nos. 4,315,070, 4,183,752, 3,961,959 or 4,171,223.

Preferred examples of A are those coupler residual groups which can be represented by the general formulae (Cp-1), (Cp-2), (Cp-3), (Cp-4), (Cp-5), (Cp-6), (Cp-7), (Cp-8), and (Cp-9) which are shown below. These couplers have a high coupling rate and are preferred.

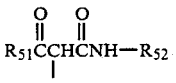

General Formula (Cp-1)

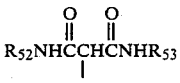

General Formula (Cp-2)

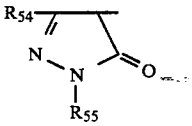

General Formula (Cp-3)

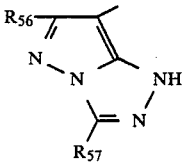

General Formula (Cp-4)

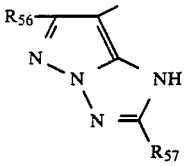

General Formula (Cp-5)

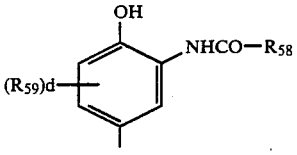

General Formula (Cp-6)

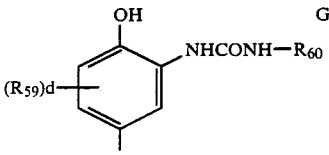

General Formula (Cp-7)

-continued

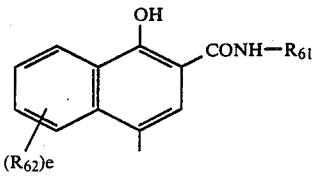

General Formula (Cp-8)

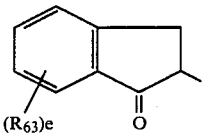

General Formula (Cp-9)

In these formulae, the free bond at the coupling position indicates the bonding position of the group which is eliminated by the coupling reaction.

In cases where the groups $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, and $R_{63}$ in the above mentioned formulae contain groups which are fast to diffusion, they are selected in such a way that the total number of carbon atoms is from 8 to 40 and preferably from 10 to 30 while in order cases the total number of carbon atoms is preferably not more than 15. In the case of bis type, telomer type and polymer type couplers, any of the above mentioned substituents may take the form of a divalent group for connecting the repeating units together, etc., in which case the number of carbon atoms may be outside the range specified above.

The group $R_{51}$–$R_{63}$, d and e are described in detail below. Here $R_{41}$ represents an aliphatic group, an alicyclic group, an aromatic group or a heterocyclic group, $R_{42}$ represents an aromatic group or a heterocyclic group and $R_{43}$, $R_{44}$ and $R_{45}$ represent hydrogen atoms, aliphatic groups, aromatic groups or heteroxcyclic groups.

$R_{51}$ has the same significance as $R_{41}$. $R_{52}$ and $R_{53}$ both have the same significance as $R_{42}$. $R_{54}$ is a group which has the same significance as $R_{41}$, an

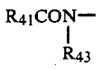

group, an

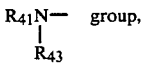

group, an

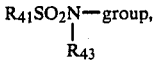

an $R_{41}S$— group, an $R_{43}O$— group, an

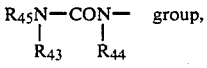

group, an $R_{41}OOC$— group, an $R_{44}NCO-$ ($R_{43}$)

group or an N=C— group.

$R_{55}$ represents a group which has the same significance as $R_{41}$. $R_{56}$ and $R_{57}$ are each groups of the same significance as an $R_{43}$ group, $R_{41}S$— groups, $R_{43}O$— groups, $R_{41}CON-$ ($R_{43}$)

groups, $R_{41}N-$ ($R_{43}$)

groups, $R_{43}N-CON-$ ($R_{44}$, $R_{45}$)

groups or $R_{41}SO_2N-$ ($R_{43}$)

groups. $R_{58}$ represents a group which has the same significance as $R_{41}$. $R_{59}$ represents a group which has the same significance as $R_{41}$, an $R_{41}CON-$ ($R_{43}$)

group, an $R_{41}OCON-$ ($R_{43}$) group, $R_{41}SO_2N-$ ($R_{43}$) group, an $R_{43}N-CON-$ ($R_{44}$, $R_{45}$) group, an $R_{43}NSO_2N-$ ($R_{44}$, $R_{45}$) group, an $R_{41}O$— group, an $R_{41}S$— group, a halogen atoms or an $R_{41}N-$ ($R_{43}$)

group.

Moreover d represents 0–3.

When d is greater than 1, the plurality of $R_{59}$ groups may represent the same or different substituents. Furthermore, the $R_{59}$ groups may be divalent groups which are joined together to form a ring structure. Examples of divalent groups for forming ring structures include

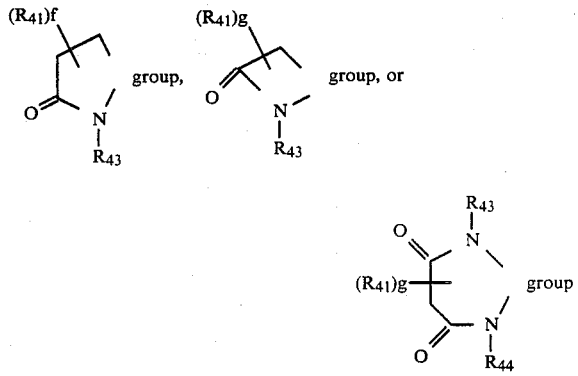

Here f is an integer of value 0 to 4 and g is an integer of value 0 to 2. $R_{60}$ represents a group which has the same significance as $R_{41}$. $R_{61}$ represents a group which has the same significance as $R_{41}$. $R_{62}$ represents a group which has the same significance as $R_{41}$, an $R_{41}CONH$— group, an $R_{41}OCONH$— group, an $R_{41}SO_2NH$— group, an $R_{43}N-CON-$ ($R_{44}$, $R_{45}$)

group, an $R_{43}NSO_2N-$ ($R_{44}$, $R_{45}$)

group, an $R_{43}O$— group, an $R_{41}S$— group, a halogen atom or an $R_{41}N-$ ($R_{43}$)

group. $R_{63}$ represents a group of the same significance as $R_{41}$, an $R_{43}CON-$ ($R_{44}$)

group, an $R_{43}NCO-$ ($R_{44}$)

group, an $R_{41}SO_2N-$ ($R_{44}$)

group, an $R_{43}NSO_2-$ ($R_{44}$)

group, an $R_{41}SO_2$— group, an $R_{43}OCO$— group, an $R_{43}O$—$SO_2$— group, a halogen atom, a nitro group, a cyano group or an $R_{43}CO$— group. Moreover, e represents an integer of value 0 to 4. When there is more than one $R_{62}$ or $R_{63}$ group these groups may be the same or different.

In the description above, an aliphatic group is an aliphatic hydrocarbyl group, which has from 1 to 32, and preferably from 1 to 22, carbon atoms, which may be saturated or unsaturated, which may have a linear or branched chain structure and which may or may not have substituent groups. Typical examples include a methyl group, an ethyl group, a propyl group, an isopropyl group, a butyl group, a tert-butyl group, an iso-butyl group, a tert-amyl group, a hexyl group, a 2-ethylhexyl group, an octyl group, a 1,1,3,3-tetramethylbutyl group, a decyl group, a dodecyl group, a hexadecyl group and an octadecyl group.

In the description above, an alicyclic group is an alicyclic hydrocarbyl groups, which has from 3 to 32, and preferably from 3 to 22, carbon atoms, which may be saturated or unsaturated and which may or may not have substituent groups. A typical example includes a cyclohexyl group.

The aromatic groups are a group which have from 6 to 20 carbon atoms, preferably substituted or unsubstituted phenyl groups or substituted or unsubstituted naphthyl groups.

The heterocyclic groups are preferably three to eight membered substituted or unsubstituted heterocyclic groups, which have atoms selected from among nitrogen, oxygen and sulfur atoms as the hetero atoms and which have from 1 to 20, and preferably from 1 to 7, carbon atoms. Typical examples of heterocyclic groups include the 2-pyridyl group, 4-pyridyl group, 2-thienyl group, 2-furyl group, 2-imidazolyl group, pyrazinyl group, 2-pyrimidyl group, 1 imidazolyl group, 1 indolyl group, phthalimido group, 1,3,4-thiadiazol 2-yl group, benzoxazol-2-yl group, 2-quinolyl group, 2,4-dioxo-1,3-imidazolidin-5-yl group, 2,4-dioxo-1,3-imidazolidin-3-yl group, succinimido group, phthalimido group, 1,2,4-triazol-2-yl group and 1-pyrazolyl group.

Typical substituents in cases where the aforementioned aliphatic hydrocarbyl groups, alicyclic hydrocarbyl groups, aromatic groups and heterocyclic groups have substituents include halogen atoms, $R_{47}O$— groups, $R_{46}S$— groups, $$R_{47}CON(R_{48})-$$

groups, $$R_{47}NCO(R_{48})-$$

groups, $$R_{46}OCON(R_{47})-$$

groups, $$R_{46}SO_2N(R_{47})-$$

groups, $$R_{47}NSO_2(R_{48})-$$

groups, $R_{46}SO_2$— groups, $R_{47}OCO$— groups, $$R_{47}N(R_{48})-CON(R_{49})-$$

groups, groups represented by $R_{46}$,

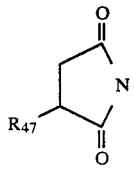

groups, $R_{46}COO$— groups, $R_{47}OSO_2$— groups, cyano groups and nitro groups. Here, $R_{46}$ represents an aliphatic group, an aromatic group or a heterocyclic group and $R_{47}$, $R_{48}$ and $R_{49}$ each represent aliphatic groups, aromatic groups, heterocyclic groups or hydrogen atoms. The significance of the terms aliphatic group, aromatic group and heterocyclic group as used here is the same as that defined above.

The preferred scope of $R_{51}$–$R_{63}$, d and e is described below.

$R_{51}$ is preferably an aliphatic group or an aromatic group. $R_{52}$, $R_{53}$ and $R_{55}$ are preferably aromatic groups. $R_{54}$ is preferably an $R_{41}CONH$— group or an $$R_{41}-N(R_{43})-$$

group. $R_{56}$ and $R_{57}$ are preferably aliphatic groups, $R_{41}O$— groups or $R_{41}S$— groups. $R_{58}$ is preferably an aliphatic group or an aromatic group. $R_{59}$ in general formula (Cp-6) is preferably a chlorine atom, an aliphatic group or an $R_{41}CONH$— group. Moreover d preferably has a value of 1 or 2. $R_{60}$ is preferably an aromatic group. $R_{59}$ in general formula (Cp-7)is preferably an $R_{41}CONH$— group. Moreover d in general formula (Cp-7) is preferably 1. $R_{61}$ is preferably an aliphatic group, an alicyclic group or an aromatic group. In general formula (Cp-8) the value of e is preferably 0 or 1. $R_{62}$ is preferably an $R_{41}OCONH$— group, an $R_{41}CONH$— group or an $R_{41}SO_2NH$— group and the preferred substitution position of these groups is the 5-position of the naphthol ring. $R_{63}$ is preferably an $R_{41}CONH$— group, an $R_{41}SO_2NH$— group, an $$R_{41}NSO_2(R_{43})-$$

group, an $R_{41}SO_2$— group, an

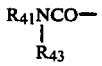

group, a nitro group or a cyano group.

Typical examples of $R_{51}$–$R_{63}$ are described below.

Thus $R_{51}$ may be a tert butyl group, 4-methoxyphenyl group, phenyl group, 3-{2-(2,4-di-tert-amylphenoxy)-butanamido}phenyl group, 4-octadecyloxyphenyl group or a methyl group. $R_{52}$ and $R_{53}$ may be 2-chloro-5-tetradecyloxycarbonylphenyl groups, 2-chloro-5-hexadecylsulfonamidophenyl groups, 2-chloro-5-tetradecanamidophenyl groups, 2-chloro-5-{4-(2,4-di-tert-amylphenoxy)butanamido}phenyl groups, 2-chloro-5-{2-(2,4-di-tert-amylphenoxy)butanamido)phenyl groups, 2-methoxyphenyl groups, 2-methoxy-5-tetradecyloxycarbonylphenyl groups, 2-chloro-5-(1-ethoxycarbonylethoxycarbonyl)phenyl groups, 2-pyridyl groups, 2-chloro-5-octyloxycarbonylphenyl groups, 2,4-dichlorophenyl groups, 2-chloro-5-(1-dodecyloxycarbonylethoxycarbonyl)phenyl groups, 2-chlorophenyl groups or 2-ethoxyphenyl groups.

$R_{54}$ may be a 3-{2-(2,4-di-tert-amylphenoxy)-butanamido}benzamido group, 3-{4-(2,4-di-tert-amylphenoxy)butanamido}benzamido group, 2-chloro-5-tetradecanamidoanilino group, 5-(2,4-di-tert-amylphenoxyacetamido)benzamido group, 2-chloro-5dodecenylsuccinimidoanilino group, 2-chloro-5-(2-(3-tert-butyl-4-hydroxyphenoxy)tetradecanamido)anilino group, 2,2dimethylpropanamido group, 2-(3-pentadecylphenoxy)butanamido group, pyrrolidino group or an N,N-dibutylamino group. $R_{55}$ is preferably a 2,4,6-trichlorophenyl group, 2-chlorophenyl group, 2,5-dichlorophenyl group, 2,3-ichlorophenyl group, 2,6-dichloro-4-methoxyphenyl group, 4-{2-(2,4-di-tert-amylphenoxy)butanamido}phenyl group or a 2,6-dichloro-4-methanesulfonylphenyl group. $R_{56}$ may be a methyl group, ethyl group, isopropyl group, methoxy group, ethoxy group, methylthio group, ethylthio group, 3-phenylureido group, 3-butylureido group or a 3-(2,4-di-tert-amylphenoxy)propyl group. $R_{57}$ may be a 3-(2,4-di-tert-amy(phenoxy)propyl group, 3-[4-{2-[4-(4-hydroxyphenylsulfonyl)phenoxy]-tetradecanamido} phenyl]-propyl group, methoxy group, ethoxy group, methylthio group, ethylthio group, methyl group, 1-methyl-2-{2-octyloxy-5-[2-octyloxy-5-( 1,1,3,3-tetramethylbutyl)phenylsulfonamido]-phenylsulfonamido}ethyl group, 3-{4-(4-dodecyloxyphenylsulfonamido)phenyl}propyl group, 1,1-dimethyl-2-{2-octyloxy-5-(1,1,3,3-tetramethylbutyl)phenylsulfonamido}ethyl group or a dodecylthio group. $R_{58}$ may be a 2 chlorophenyl group, pentafluorophenyl group heptafluoropropyl group, 1-(2,4-di-tert-amylphenoxy)-propyl group, 3-(2,4-di-tert-amylphenoxy)propyl group, 2,4-di-tert-amylphenoxymethyl group or a furyl group. $R_{59}$ may be a chlorine atom, methyl group, ethyl group, propyl group, butyl group, iso-propyl group, 2-(2,4-di-tert-amylphenoxy)butanamido group, 2 (2,4-di-tert-amylphenoxy)hexanamido group, 2-(2,4-di-tert-octylphenoxy)octanamido group, 2-(2 chlorophenoxy)-tetradecanamido group, 2,2-dimethylpropanamido group, 2-{4-(4-hydroxyphenylsulfonyl)phenoxy}tetradecanamido group or a 2-{2-(2,4-di-tert-amylphenoxyacetamido)phenoxy}butanamido group. $R_{60}$ may be for example a 4-cyanophenyl group, 2-cyanophenyl group, 4-butylsulfonylphenyl group, 4-chloro-3-cyanophenyl group, 4-propylsulfonylphenyl group, 4-ethoxycarbonyl-phenyl group, 4-N,N-diethylsulfamoylphenyl group, 3,4-dichlorophenyl group or a 3-methoxycarbonylphenyl group. $R_{61}$ may be a dodecyl group, hexadecyl group, cyclohexyl group, butyl group, 3-(2,4-di-tert-amyl-phenoxy)propyl group, 4-(2,4-di-tert-amylphenoxy)-butyl group, 3-dodecyloxypropyl group, 2-tetradecyloxyphenyl group, tert-butyl group, 2-(2-hexyldecyloxy)phenyl group , 2-methoxy-5-dodecyloxycarbonylphenyl group, 2-butoxyphenyl group or a 1-naphthyl group. $R_{62}$ may be an iso-butyloxycarbonylamino group, ethoxycarbonylamino group, phenylsulfonylamino group, methansulfonamido group, butansulfonamido group, 4-methylbenzenesulphonamido group, benzamido group, trifluoroacetamido group, 3-phenylureido group, butoxycarbonylamino group or an acetamido group. $R_{63}$ may be a 2,4-di-tert-amylphenoxyacetamido group, 2-(2,4-di-tert-amylphenoxy)butanamido group, hexadecylsulfonamido group, N-methyl N-octadecylsulfomoyl group, N,N-dioctylsulfamoyl group, dodecyloxycarbonyl group, chlorine atom, fluorine atom, nitro group, cyano group, N-3-(2,4-di-tert-amylphenoxy)propylsulfamoyl group, methansulfonyl group or a hexadecylsulfonyl group.

The group represented by TIME in general formulae [I]–[IV] may or may not be present in the present invention. Preferably, no such group is used, but such groups can be selected appropriately as required. When such a group is used, it may be one of the known linking groups of the types indicated below.

(1) Groups in which use is made of a hemi-acetal cleavage reaction.

For example, the groups represented by the general formulae indicated below and which are disclosed in U.S. Pat. No. 4,146,396 and Japanese Patent Application (OPI) Nos. 249,148/85 and 249,149/85. In these general formulae, * indicates the bonding position on the left hand side in general formulae [I]–[IV] and ** indicates the bonding position on the right hand side in general formulae [I]–[IV].

General Formula (T-1)

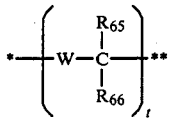

In this formula, W represents an oxygen atom, a sulfur a tom or an

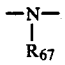

group, $R_{65}$ and $R_{66}$ represent hydrogen atoms or substituent groups, $R_{67}$ represents a substituent group and t has a value of 1 or 2. When t has a value of 2 the

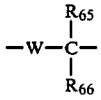

units may be the same or different. Typical examples of the substituents represented by $R_{65}$, $R_{66}$ and $R_{67}$ are $R_{69}$ groups, $R_{69}CO$— groups, $R_{69}SO_2$— groups,

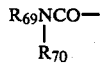

groups and

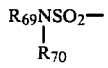

groups.

Here $R_{69}$ is a group which has the same significance as $R_{41}$, which has been described already and $R_{70}$ is a group which has the same significance as $R_{43}$ defined above. $R_{65}$, $R_{66}$ and $R_{67}$ may each represent divalent groups and include causes in which these groups are linked together to form ring structures. Actual examples of groups which can be represented by the general formula (T-1) are shown below.

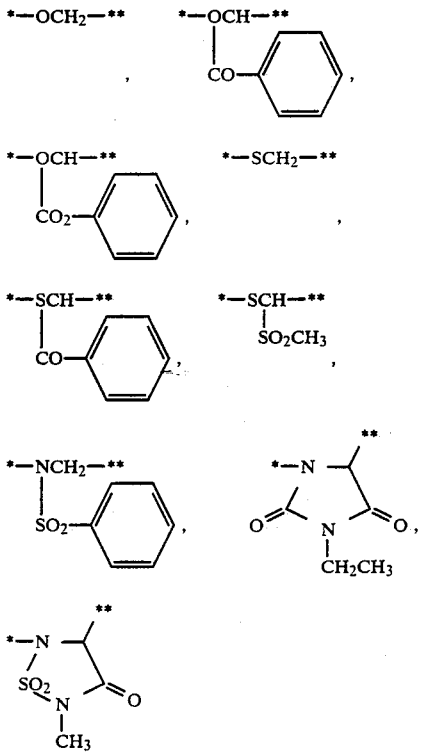

(2) Groups in which a cleavage reaction is brought about on the basis of an intramolecular nucleophilic substitution reaction.

For example, the timing groups which are disclosed in U.S. Pat. No. 4,248,962. These can be represented by the following general formula:

General Formula (T-2)

*-Nu-Link-E-**

In this formula, * indicates the bonding position on the left hand side in the general formulae [I]-[IV] and  indicates the bonding position on the right hand side in the general formulae [I]-[IV], Nu represents a nucleophilic group, such as an oxygen atom or a sulfur atom, and E represents an electrophilic group, which is subjected to a nucleophilic attack by the Nu group, resulting in cleavage of the  bond, and Link is a linking group which provides a steric relationship which enables the groups Nu and E to undergo an intramolecular substitution reaction. Actual examples of groups which can be represented by the general formula (T-2) are indicated below.

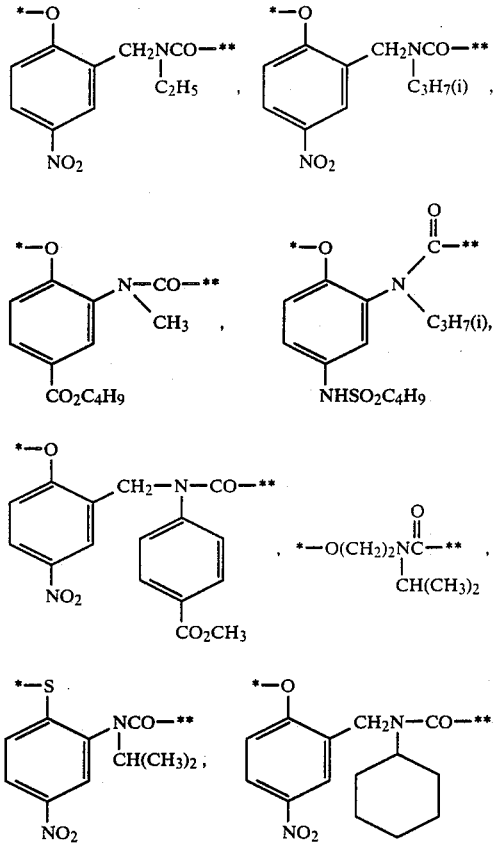

(3) Groups in which cleavage is brought about using an electron transfer reaction along a conjugated system.

For example, the groups disclosed in U.S. Pat. Nos. 4,409,323 or 4,421,845 and which can be represented by the following general formula:

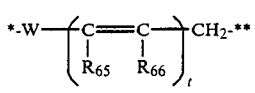

General Formula (T-3)

In this formula, *, **, W, $R_{65}$, $R_{66}$ and t all have the same significance as those described in connection with the general formula (T-1). Actual examples of these groups are indicated below.

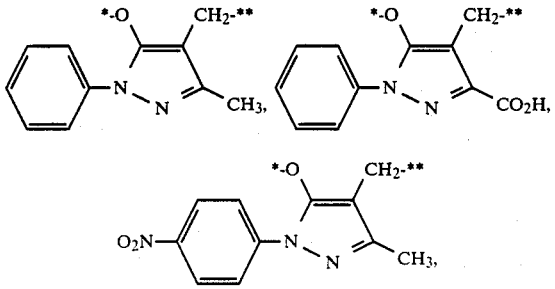

-continued

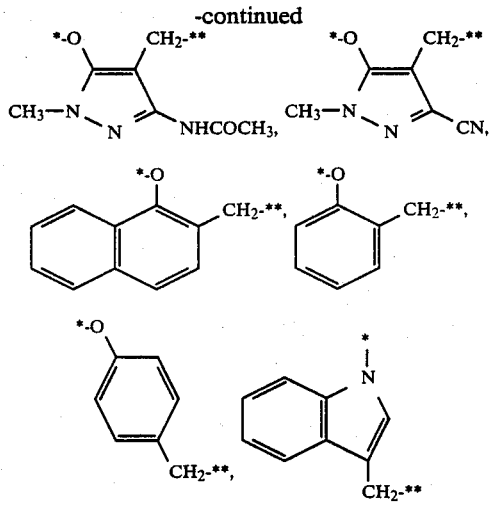

(4) Groups in which use is made of a cleavage reaction due to the hydrolysis of an ester.

For example, linking groups as disclosed in West German Patent (OLS) No. 2,626,315 (wherein "OLS" means it has been made available for public inspection) given below. In this formula * and ** have the same significance as described earlier in connection with general formula (T-1).

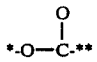

General Formula (T-4)

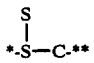

General Formula (T-5)

(5) Groups in which use is made of an imino-ketal cleavage reaction.

For example the linking groups which are disclosed in U.S. Pat. No. 4,546,073 and which can be represented by the following general formula:

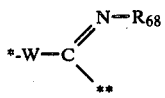

General Formula (T-6)

In this formula, *, ** and W have the same significance as those described in connection with general formula (T-1) and $R_{68}$ has the same significance as $R_{67}$. Actual examples of groups which can be represented by the general formula (T-6) are indicated below.

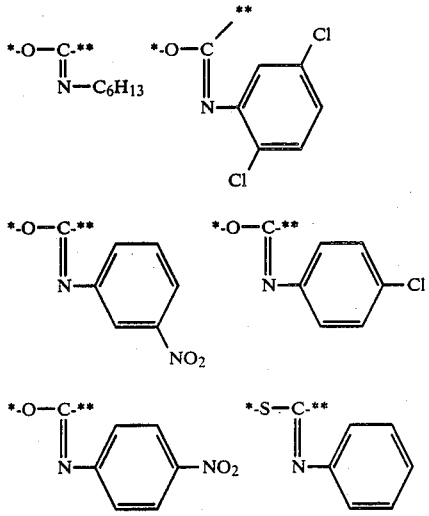

Actual examples of development inhibitor releasing type couplers which release a precursor of a compound which inhibits the development of silver halide by means of a coupling reaction with the oxidized form of a primary aromatic amine developing agent and with which the said precursor subsequently releases, by means of an intramolecular electron transfer reaction which takes place via an ethylenic conjugated chain, a compound which inhibits the development of silver halide of the type used in the present invention are shown below, but the invention is not limited to these examples.

(D-1)

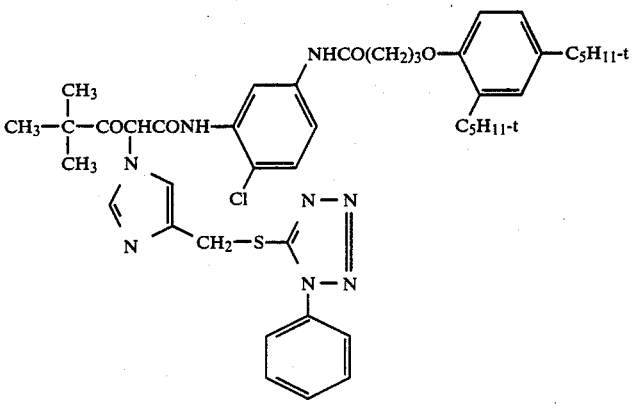

-continued
(D-2)
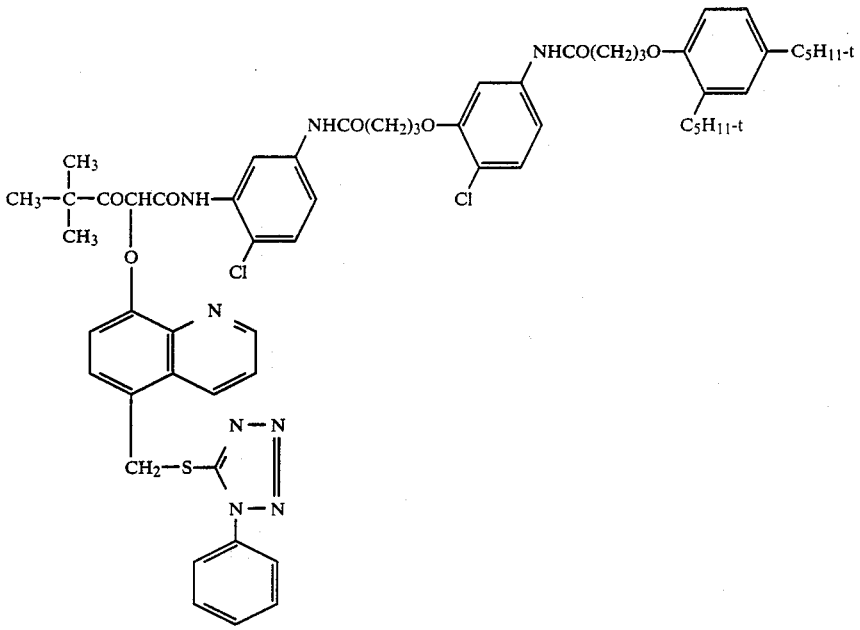
(D-3)
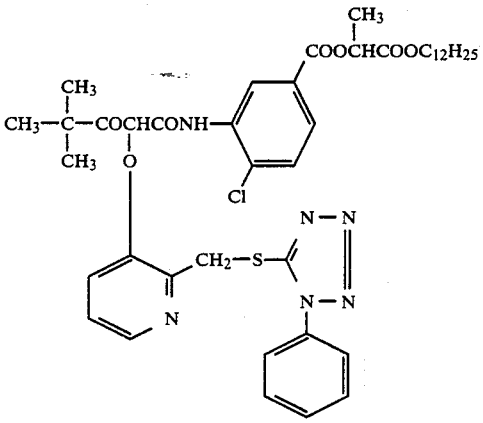
(D-4)
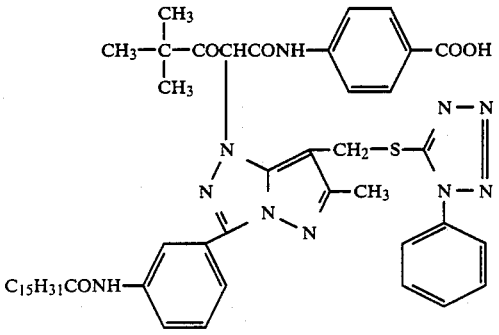

-continued
(D-5)
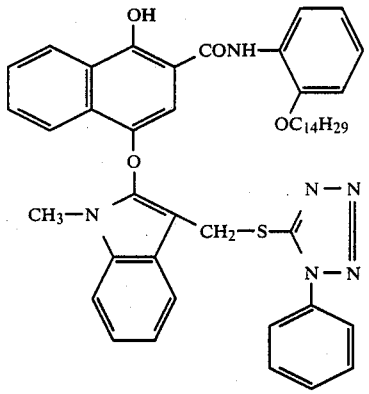
(D-6)
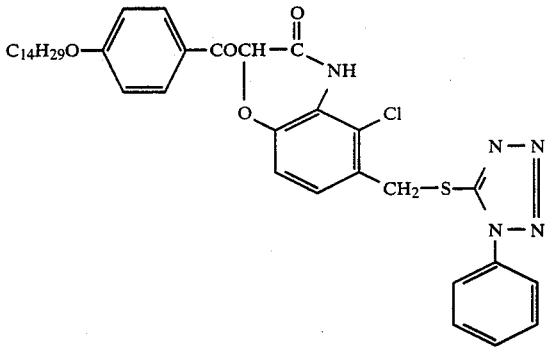
(D-7)
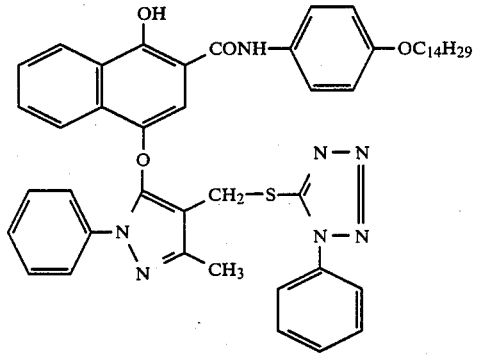
(D-8)
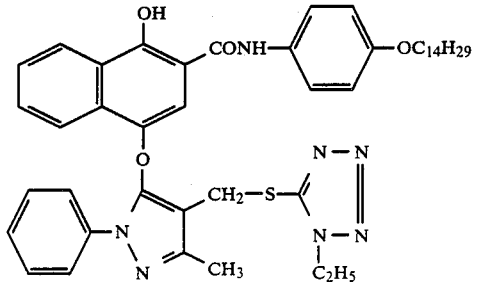

-continued
(D-9)
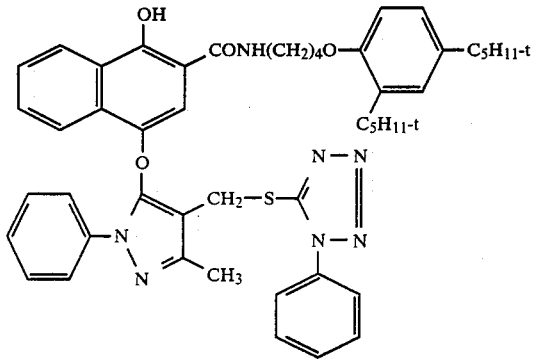
(D-10)
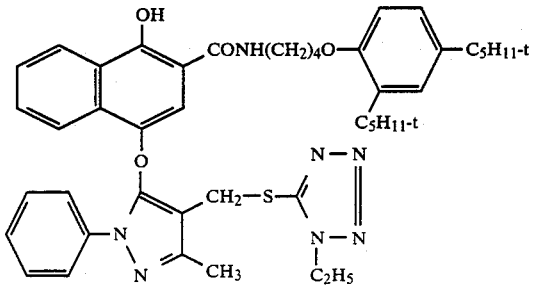
(D-11)
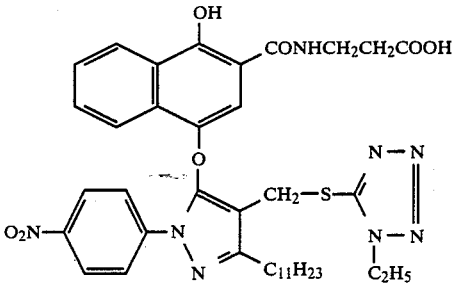
(D-12)
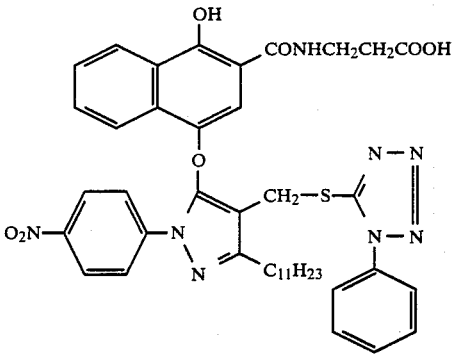
(D-13)
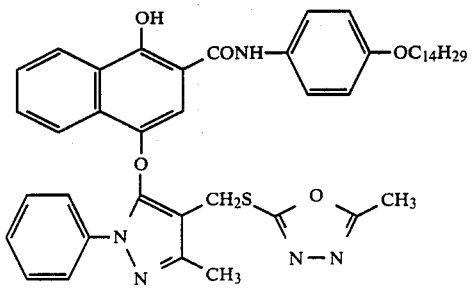

-continued
(D-14)
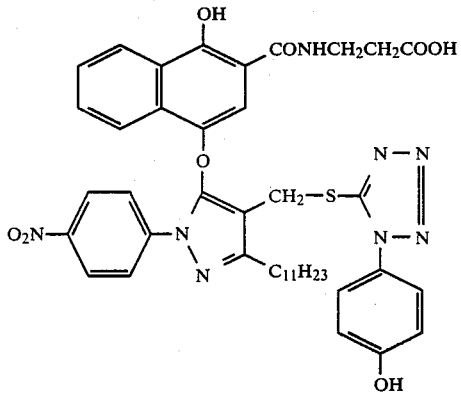
(D-15)
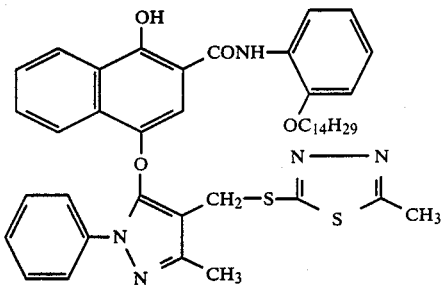
(D-16)
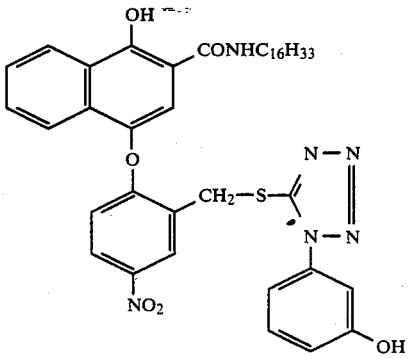
(D-17)
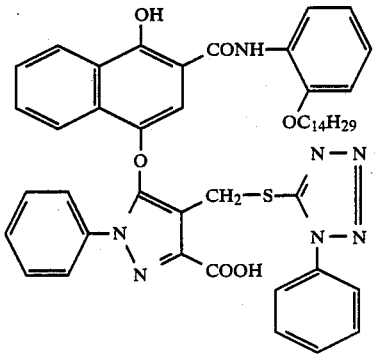

-continued
(D-18)
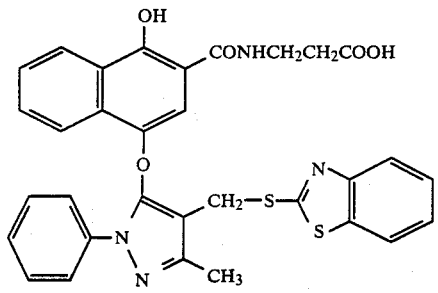
(D-19)
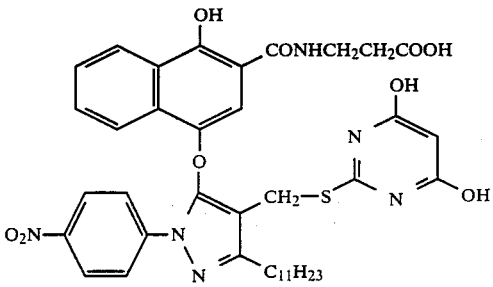
(D-20)
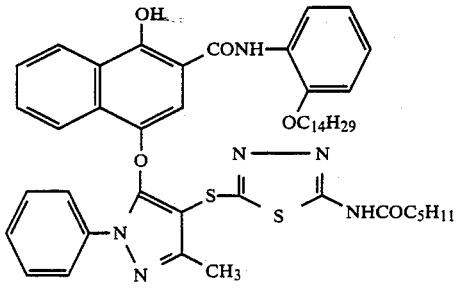
(D-21)
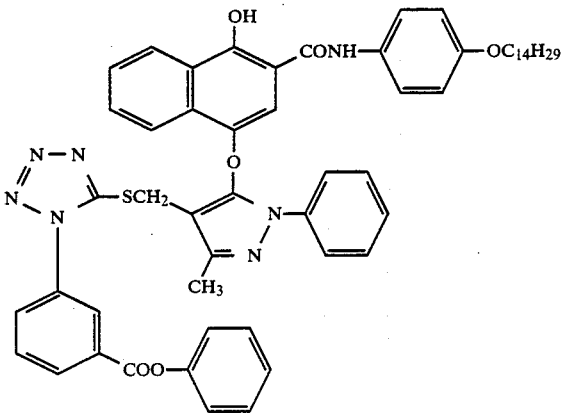

-continued (D-22)

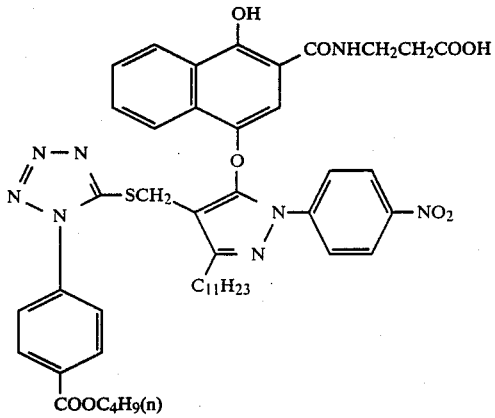

These development inhibitor releasing type couplers can be prepared for example using the methods disclosed in U.S. Pat. No. 4,421,845 and Japanese Patent Application (OPI) Nos. 188,035/82, 98,728/83, 209,736/83, 209,737/83, 209,738/83 and 209,740/83 etc.

Actual examples of bleach accelerating agent releasing type couplers which can be used in the invention are shown below, but the present invention is not limited by these examples.

(E-1)

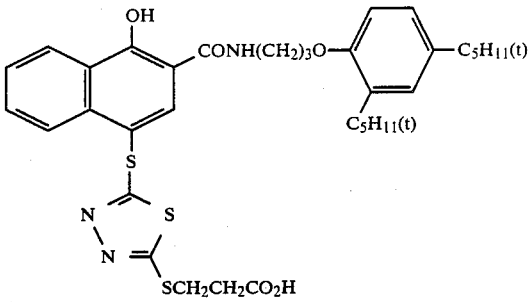

(E-2)

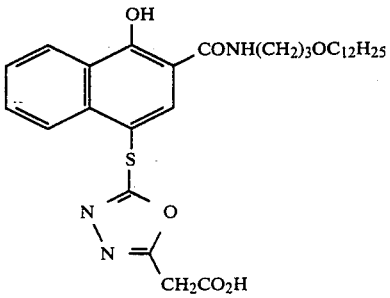

(E-3)

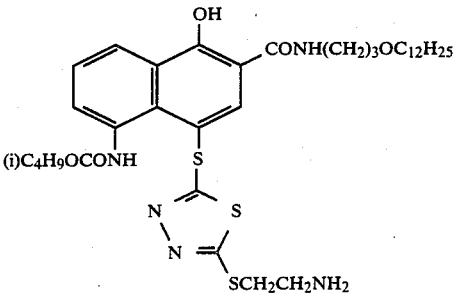

-continued
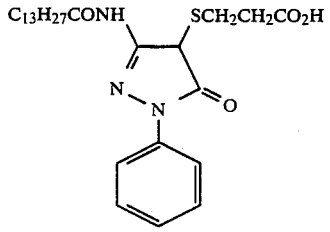
(E-4)
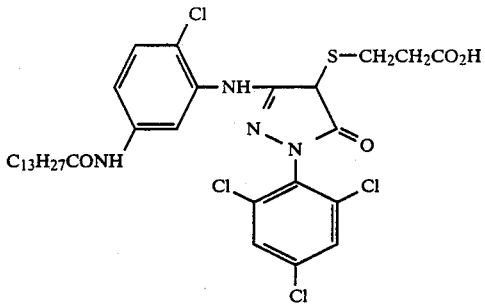
(E-5)
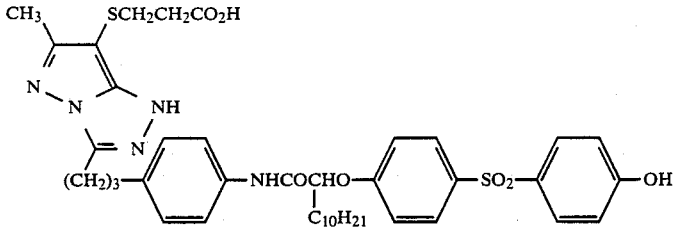
(E-6)
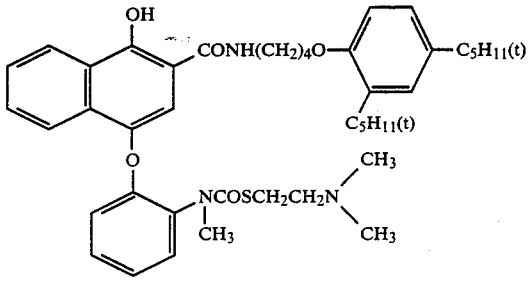
(E-7)
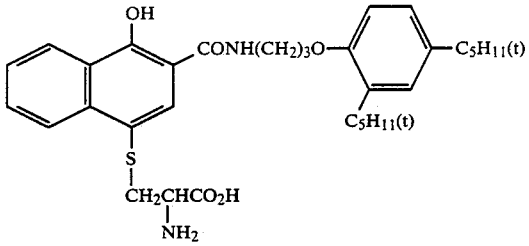
(E-8)
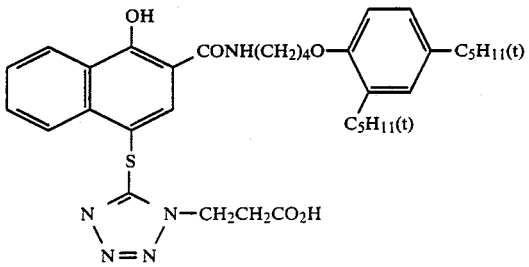
(E-9)

-continued
(E-10)
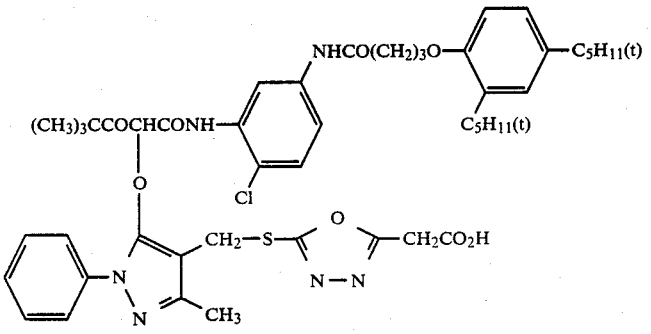
(E-11)
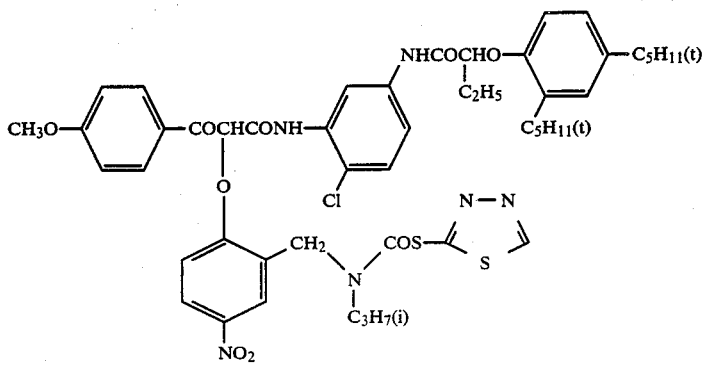
(E-12)
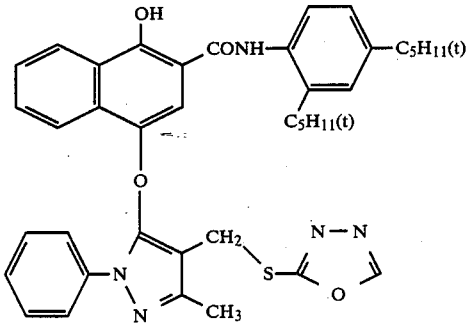
(E-13)
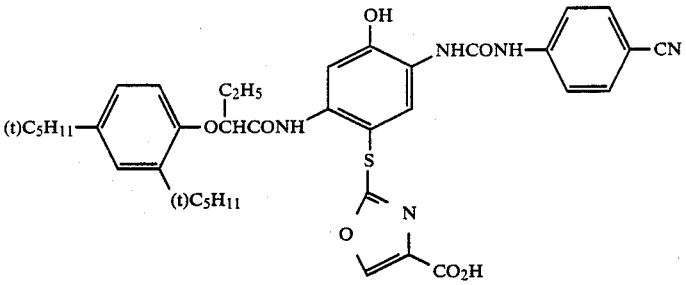
(E-14)
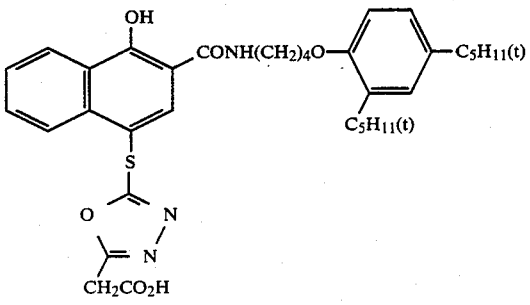

-continued
(E-15)
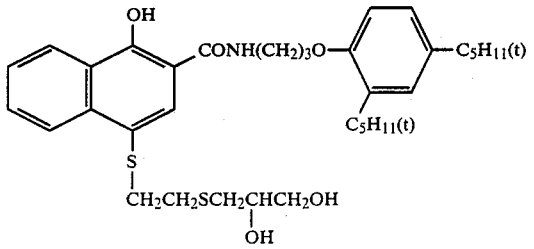
(E-16)
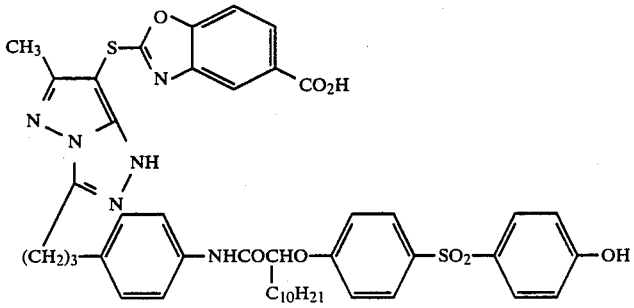
(E-17)
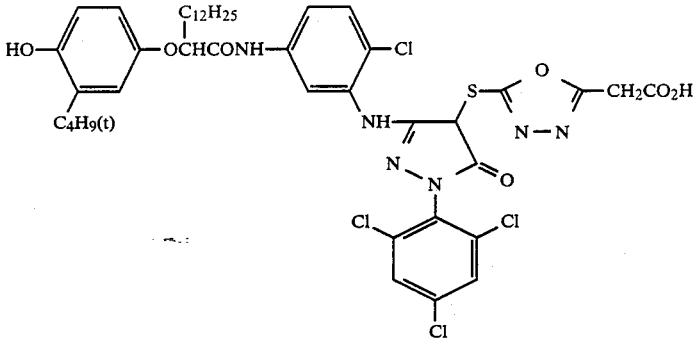
(E-18)
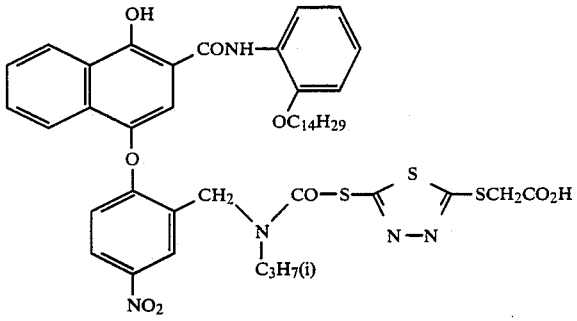
(E-19)
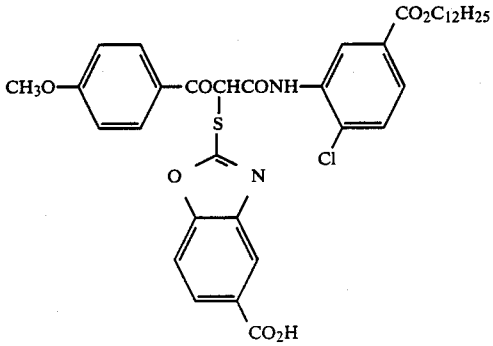

-continued
(E-20)
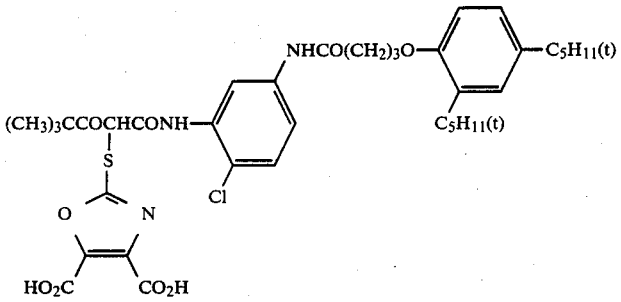
(E-21)
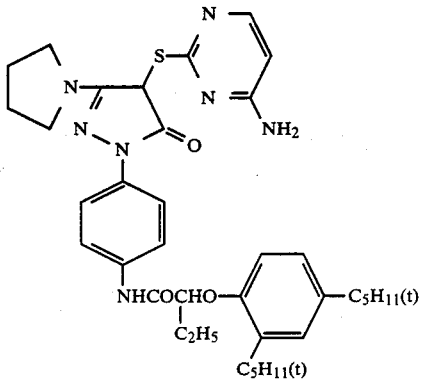
(E-22)
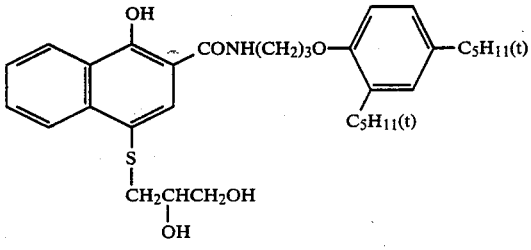
(E-23)
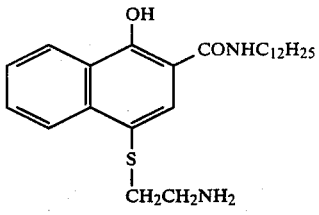
(E-24)
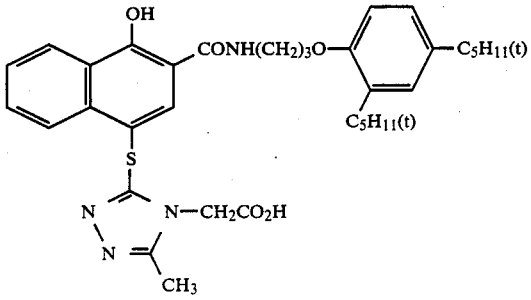

-continued
(E-25)
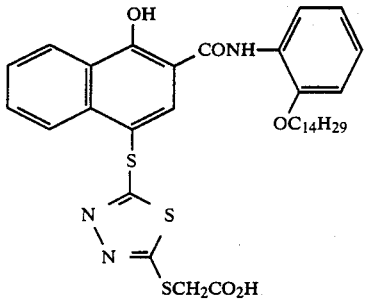
(E-26)
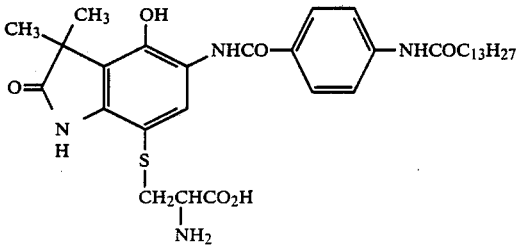
(E-27)
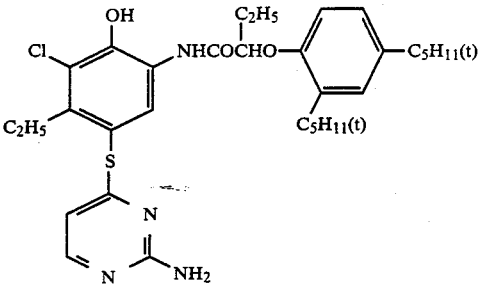
(E-28)
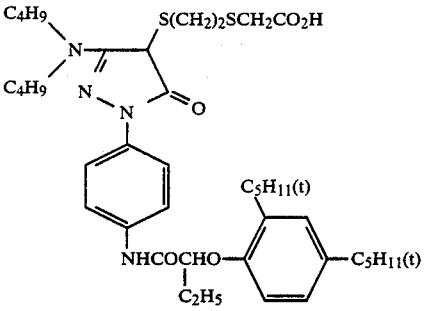
(E-29)
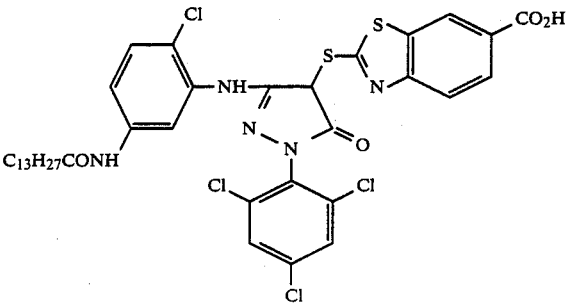

-continued
(E-30)
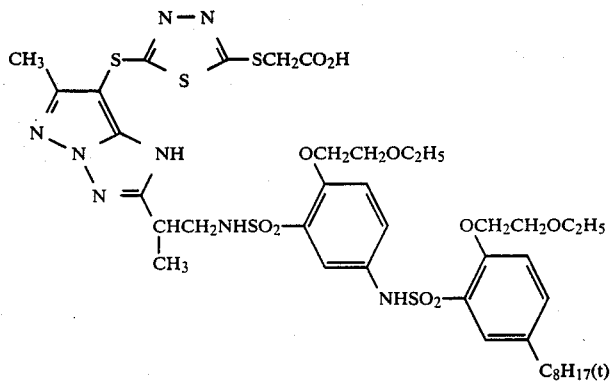
(E-31)
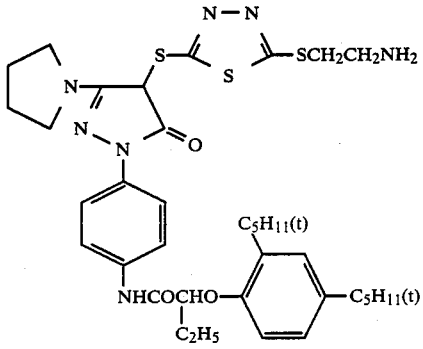
(E-32)
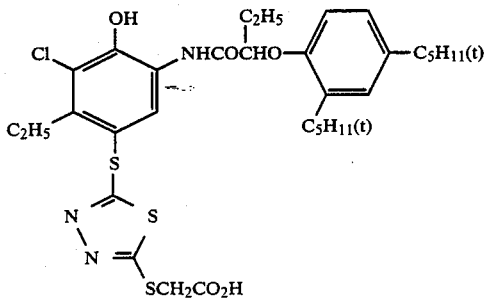
(E-33)
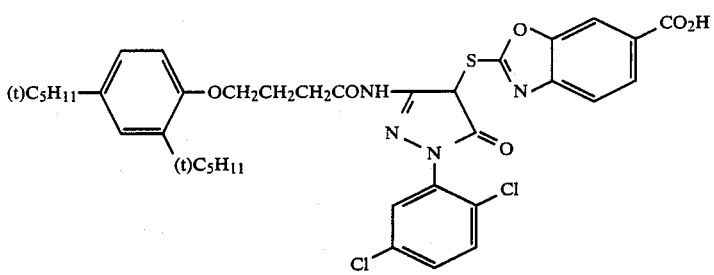
(E-34)
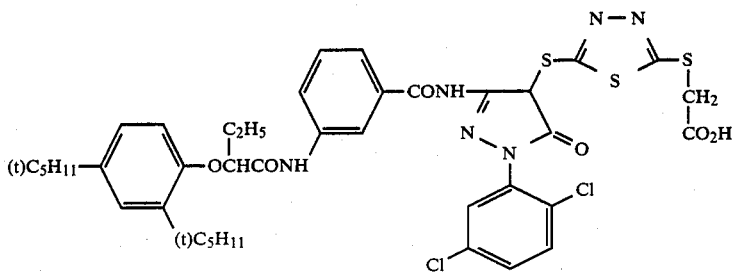

-continued
(E-35)
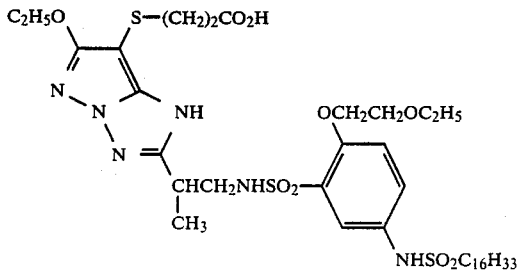
(E-36)
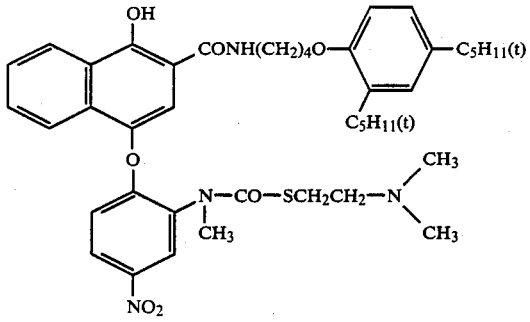
(E-37)
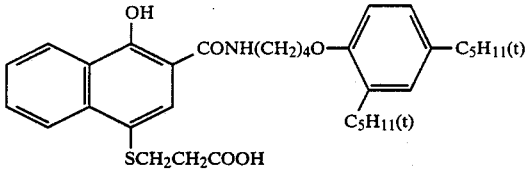
(E-38)
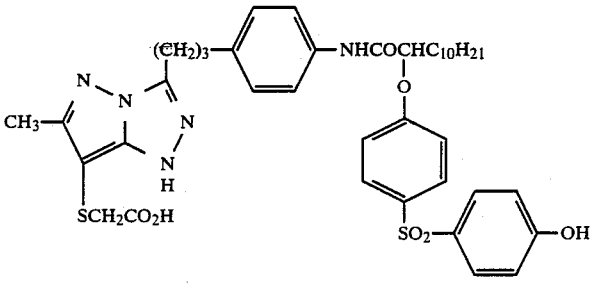
(E-39)
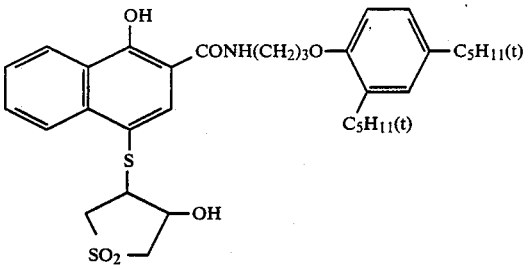
(E-40)
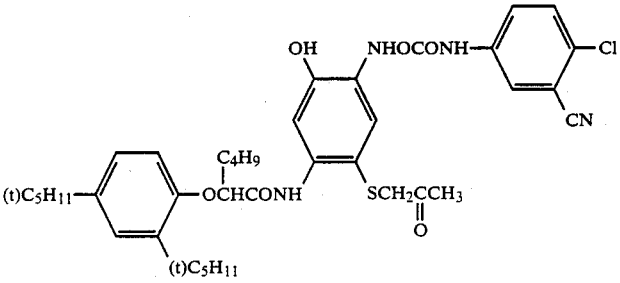

-continued (E-41)

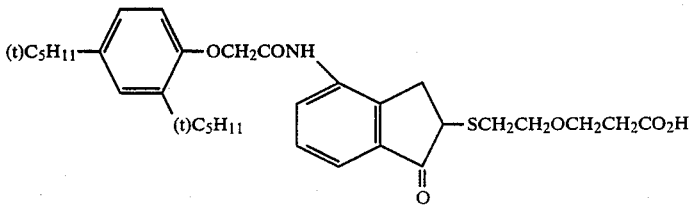

(E-42)

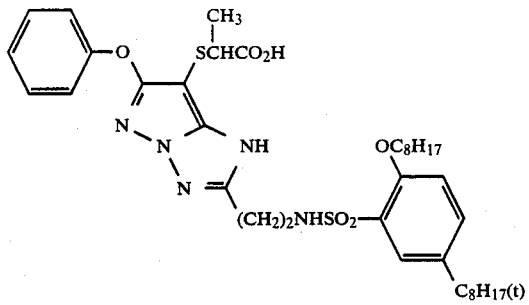

(E-43)

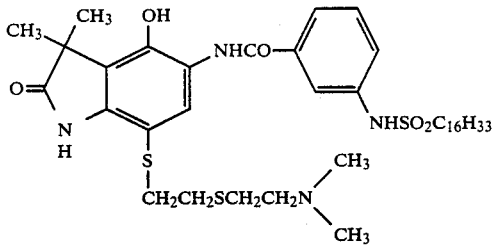

The bleach accelerating agent releasing type couplers which can be used in the present invention can be prepared using the methods disclosed in U.S. Pat. No. 4,264,723 and Japanese Patent Application (OPI) No. 201,247/83.

The amount of the development inhibitor releasing type coupler used in the present invention is from $1\times10^{-5}$ mol % to $1\times10^{-1}$ mol %, and preferably from $1\times10^{-4}$ mol % to $1\times10^{-2}$ mol %, with respect to the total amount of silver coated. The amount added is determined by the coupling rate of the coupler, the rate at which the development inhibitor is released from the timing precursor and the silver development inhibiting capacity of the development inhibitor which is released. A larger amount has to be added when these rates are low or when the inhibiting capacity is weak.

The amount of bleach accelerating agent releasing coupler used in the invention is from 0.01 mol % to 100 mol %, preferably from 0.1 mol % to 50 mol %, and most desirably from 1 mol % to 20 mol %, with respect to the total amount of silver coated.

The couplers of this invention may be added to emulsion layers or to non-photosensitive intermediate and protective layers. Furthermore, two or more types of couplers can be used conjointly and they can also be used in the form of mixtures with couplers of the types that will be described later.

The silver halide contained in the photographic emulsion layers of the photographic materials in which the invention is employed is a silver chloride, silver bromide, silver chlorobromide, silver iodochloride, silver chloroiodobromide or a silver iodobromide.

The silver halide grains in the photographic emulsion may have a regular crystalline form, such as a cubic, octahedral or tetradecahedral form, an irregular crystalline form such as a spherical or lamella form, they may have crystal defects such as twinned crystal planes, etc., or they may have a complex form incorporating these forms.

The silver halide grain size may be such as to include fine grains of less than about 0.2 microns and large grains of which the projected area diameter reaches about 10 microns and the silver halide grains may take the form of a poly-dispersed emulsion or a mono-dispersed emulsion.

The silver halide photographic emulsions which can be used in the present invention can be prepared using the methods disclosed for example in *Research Disclosure* (RD) No. 17643 (December 1978), pages 22–23, "I. Emulsion Preparation and types", RD No. 18716 (November 1979), page 648, and the methods described by P. Glafkides in *Chemie et Physique Photographique,* Paul Montel, 1967, by G. F. Duffin in *Photographic Emulsion Chemistry,* Focal Press, 1966, and by Zelikman et al,. in *Making and Coating Photographic Emulsion,* Focal Press, 1964, etc.

The mono-dispersed emulsions disclosed in U.S. Pat. Nos. 3,574,628 and 3,653,394 and in British Patent No. 1,413,748, etc., are preferred.

Furthermore, lamella-like grains such that the aspect ratio is greater than about 5 can be used in the present invention. Lamella-like grains can be prepared easily using the method disclosed by Gutoff on pages 248–257 of volume 14 of *Photographic Science and Engineering* (1970), and the methods disclosed in U.S. Pat. Nos.

4,434,226, 4,414,310, 4,433,048 and 4,439,520 and in British Patent No. 2,112,157, etc.

The crystal structure may be uniform or the inner and outer parts may have a different halogen composition to provide a layered type of structure. Furthermore, the silver halides of different compositions may be joined with an epitaxial junction or they may be joined with a compound other than silver halide, such as silver thiocyanate or silver oxide, for example.

Mixtures of grains of various crystal forms can also be used.

Silver halide emulsions which have been physically ripened, chemically ripened and spectrally sensitized are normally used. The additives used in processes of this type are disclosed in *Research Disclosure* Nos. 17643 and 18716 and the locations of these materials in the said publications are summarized below.

Known photographic additives which can be used in the invention are also disclosed in the two above-mentioned Research Disclosures and the location of the related disclosures can be found in the table below.

| Type of Additive | RD 17643 | RD 18716 |
|---|---|---|
| 1. Chemical sensitizers | Page 23 | Page 648. right col. |
| 2. Speed increasing agents | | As above. |
| 3. Spectral sensitizers Strong color sensitizers | Pages 23–24 | Pages 648 right col. to 649 right col. |
| 4. Whiteners | Page 24 | |
| 5. Anti-foggants and Stabilizers | Pages 24–25 | Page 649 right col. |
| 6. Light absorbers, filter dyes, UV Absorbers | Pages 25–26 | Pages 649 right col. to 650, left col. |
| 7. Anti-staining agents | Page 25, right col. | Page 650 left–right col. |
| 8. Dye image stabilizers | Page 25 | |
| 9. Film hardening agents | Page 26 | Page 651, left col. |
| 10. Binders | Page 26 | As above |
| 11. Plasticizers, Lubricants | Page 27 | Page 650, right col. |
| 12. Coating promotors, Surfactants | Pages 26–27 | As above |
| 13. Anti-static agents | Page 27 | As above |

Various color couplers can be used in the present invention and actual examples are disclosed in the patents disclosed in *Research Disclosure* (RD) No. 17643, VII-(C–G).

The preferred yellow couplers are those disclosed, for example, in U.S. Pat. Nos. 3,933,501, 4,022,620, 4,326,024 and 4,401,725, Japanese Patent Publication No. 10,739/83 and British Patent Nos. 1,425,020 and 1,476,760, etc.

5-pyrazolone- and pyrazoloazole-based compounds are preferred for the magenta couplers and those disclosed in U.S. Pat. Nos. 4,310,619 and 4,351,897, European Patent No. 73,636, U.S. Pat. Nos. 3,061,432 and 3,725,067, *Research Disclosure* No. 24220 (June 1984), Japanese Patent Application (OPI) No. 33,552/85, *Research Disclosure* No. 24230 (June, 1984), Japanese Patent Application (OPI) No. 43,659/85 and U.S. Pat. Nos. 4,500,630 and 4,540,654 etc. are especially desirable.

Phenol and naphthol based couplers may be used for the cyan couplers and those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) No. 3,329,729, European Patent No. 121,365A, U.S. Pat. Nos. 3,446,622, 4,333,999, 4,451,559 and 4,427,767 and European Patent No. 161,626A etc. are preferred.

The colored couplers for correcting the unrequired absorptions of the colored dyes disclosed in section VII-G of *Research Disclosure* No. 17643, U.S. Pat. No. 4,163,670, Japanese Patent Publication No. 39,413/82, U.S. Pat. Nos. 4,004,929 and 4,138,258 and British Patent No. 1,146,368 are preferred.

Those disclosed in U.S. Pat. No. 4,366,237, British Patent No. 2,125,570, European Patent No. 96,570, and West German Patent (OLS) No. 3,234,533 are preferred as couplers in which the colored dye has suitable diffusion properties.

Typical examples of. polymerized dye forming couplers are disclosed in U.S. Pat. Nos. 3,451,820, 4,080,211 and 4,367,282 and in British Patent No. 2,102,173 etc.

The use of couplers which release residual groups which are useful photographically on coupling is preferred in this invention. The DIR couplers which release development inhibitors disclosed in the patents disclosed in sections VII-F of the aforementioned *Research Disclosure* 17643, Japanese Patent Application (OPI) Nos. 151,944/82, 154,234/82 and 184,248/85 and U.S. Pat. No. 4,248,962 are preferred.

Those couplers which release nucleating agents or development accelerating agents imagewise during development which are disclosed in British Patent Nos. 2,097,140 and 2,131,188 and in Japanese Patent Application (OPI) Nos. 157,638/84 and 170,840/84 are preferred.

Other couplers which can be used in the photosensitive materials of this invention include the competitive couplers disclosed in U.S. Pat. No. 4,130,427, etc., the poly-equivalent couplers disclosed in U.S. Pat. Nos. 4,283,472, 4,338,393 and 4,310,618, etc., the DIR redox compound releasing couplers disclosed in Japanese Patent Application (OPI) No. 185,950/85, etc., and the couplers which release a dye in which the color is restored after elimination as disclosed in European Patent No. 173,302A.

The couplers used in the present invention can be introduced into the photosensitive material using the various known methods of dispersion.

Examples of the high boiling point solvents which are used in the oil in water dispersion method are disclosed in U.S. Pat. No. 2,322,027, etc.

Furthermore, there are also methods in which polymers are used as coupler dispersion media and some of these are disclosed in Japanese Patent Publication No. 30494/73, U.S. Pat. No. 3,619,195, West German Patent No. 1,957,467 and Japanese Patent Publication No. 39,835/76.

Actual examples of the processes and effects of the latex dispersion method and of the latexes for impregnation purposes have been disclosed in U.S. Pat. No. 4,199,363, West German Patent Application (OLS) Nos. 2,541,274 and 2,541,230, etc.

Suitable supports which can be used in the present invention are disclosed, for example, on page 28 of the aforementioned *Research Disclosure* No. 17643 and in the section from the right hand column of page 647 to the left hand column on page 648 of the aforementioned *Research Disclosure* No. 18716.

Color photographic materials in accordance with this invention can be developed using the normal methods of development as disclosed on pages 28–29 of the aforementioned *Research Disclosure* No. 17643 and in the section from the left hand column to the right hand column of page 651 of *Research Disclosure* No. 18716.

The silver halide photographic materials of this invention are generally subjected to a washing and/or stabilizing process after a de-silvering process, such as fixing or bleach-fixing etc. The amount of water used in the washing process can be set within a wide range depending on the properties (for example, the couplers, etc., which have been used) and application of the photosensitive material, the temperature of the wash water, the number of water tanks (the number of stages), whether replenishment is carried out with a counter-flow system or a sequential flow system and a variety of other factors. Of these, the relationship between the number of washing tanks in a multi-stage counter-flow system and the amount of water used can be found with the method proposed on pages 248–253 of volume 64 of the Journal of the Society of Motion Picture and Television Engineers (May 1955).

The amount of wash water used can be greatly reduced by using the multi-stage counter-flow system disclosed in the aforementioned literature, but bacterial growth is propagated as a result of the increased residence time of the water in the tanks and problems arise with the attachment of the sediments which are formed to the photosensitive materials, for example. The method in which the levels of calcium and magnesium are reduced as disclosed in Japanese Patent Application No. 131,632/86 can be used very effectively as a means of overcoming problems of this type. Furthermore use can also be made of the chlorine-based disinfectants, such as chlorinated sodium isocyanurate, the thiabendazoles and the isothiazolone compounds disclosed in Japanese Patent Application (OPI) No. 8,542/72, the benzotriazoles, etc., and the disinfectants disclosed in *The Chemistry of Bactericides and Fungicides* by Horiguchi, the Health Technology Society Publication entitled "Disinfection and Sterilization of Micro-organisms and Fungicidal Techniques" and in the Japanese Bactericide and Fungicide Society Publication entitled *A Dictionary of Bactericides and Fungicides.*

The pH value of the wash water when processing photosensitive materials of this invention is from 4 to 9 and the preferred pH is from 5 to 8. The wash water temperature and washing time can be set in accordance with the properties and application, etc., of the photosensitive material, but,. in general, a washing time of from 20 seconds to 10 minutes at 15°–45° C. and preferably of from 30 seconds to 5 minutes at 25°–40° C. is selected.

Moreover, the photosensitive materials of this invention are preferably treated with a direct stabilizing bath rather than the washing process described above in order to provide image stabilization. All of the known methods for providing a stabilizing process of this type as disclosed in Japanese Patent Application (OPI) Nos. 8,543/82, 14,834/83, 184,343/84, 220,345/85, 238,832/85, 239,784/85, 239,749/85, 4,054/87 and 118,749/86, etc., can be used for this purpose. The use of stabilizing baths which contain 1-hydroxyethylidene-1, 1-disulfonic acid, 5-chloro-2-methyl-4-isothiazolin-3-one, bismuth compounds, ammonium compounds, etc., is especially desirable.

Furthermore, there are cases in which the stabilization process is carried out after the aforementioned washing process and in such cases a stabilizing bath which contains formalin and surfactant as used for the final bath for color photosensitive materials for photographic purposes can be used, for example.

The invention is described in detail below by means of examples but the invention is in no way limited by these examples. Unless stated otherwise, all parts, presents, ratios and the like are by weight.

EXAMPLE 1

Samples consisting of multi-layer color photographic materials of which the compositions of the various layers were as indicated below were prepared on an undercoated cellulose tri-acetate film support.

Composition of the Light Sensitive Layer

The amounts coated are indicated in units of g/m$^2$ of silver in the case of silver halides and colloidal silver, in units of g/m$^2$ in the case of couplers, additives and gelatin and in terms of the number of mols per mol of silver halide in the same layer in the case of the sensitizing dyes.

| | |
|---|---|
| **First Layer (Anti-Halation Layer)** | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| **Second Layer (Intermediate Layer)** | |
| Fine grained silver bromide (Average particle size 0.07μ) | 0.15 |
| Gelatin | 1.0 |
| ExC-2 | 0.02 |
| Sol-1 | 0.1 |
| **Third Layer (Low Sensitive Red Sensitive Emulsion Layer)** | |
| Silver iodobromide emulsion (AgI 2 mol %, Inner part high AgI type, Corresponding sphere diameter 0.3μ, Variation coefficient of the corresponding sphere diameter 29%, Irregular grains, Diameter/thickness ratio 2.5) | |
| Coated silver weight | 0.4 |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| **Fourth Layer (Intermediate Sensitive Red Sensitive Emulsion Layer)** | |
| Silver iodobromide emulsion (AgI 5 mol %, Inner part high AgI type, Corresponding sphere diameter 0.7μ, Variation coefficient of the corresponding sphere diameter 25%, Irregular grains, Diameter/thickness ratio 4) | |
| Coated silver weight | 0.7 |
| Gelatin | 0.5 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.02 |
| Solv-3 | 0.02 |

-continued

| Fifth Layer (High Sensitive Red Sensitive Emulsion Layer) | |
|---|---|
| Silver iodobromide emulsion (AgI 13 mol %, Inner part high AgI type, Corresponding sphere diameter 0.8μ, Variation coefficient of the corresponding sphere diameter 16%, Irregular grains, Diameter/thickness ratio 1.3) | |
| Coated silver weight | 1.0 |
| Gelatin | 1.0 |
| ExS-1 | $1.0 \times 10^{-4}$ |
| ExS-2 | $3.0 \times 10^{-4}$ |
| ExS-3 | $1 \times 10^{-5}$ |
| ExC-5 | 0.01 |
| ExC-6 | 0.15 |
| Solv-1 | 0.01 |
| Solv-2 | 0.05 |

| Sixth Layer(Intermediate Layer) | |
|---|---|
| Gelatin | 1.0 |
| Cpd-1 | 0.03 |
| Solv-1 | 0.05 |

| Seventh Layer (Low Sensitive Green Sensitive Emulsion Layer) | |
|---|---|
| Silver iodobromide emulsion (AgI 2 mol %, Inner part high AgI type, Corresponding sphere diameter 0.3μ, Variation coefficient of the corresponding sphere diameter 28%, Irregular grains, Diameter/thickness ratio 2.5) | |
| Coated silver weight | 0.30 |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |

| Eighth Layer (Intermediate Sensitive Green Sensitive Emulsion Layer) | |
|---|---|
| Silver iodobromide emulsion (AgI 4 mol %, Inner part high AgI type, Corresponding sphere diameter 0.6μ, Variation coefficient of the corresponding sphere diameter 38%, Irregular grains, Diameter/thickness ratio 4) | |
| Coated silver weight | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-5}$ |
| ExS-9 | 0.25 |
| ExS-8 | 0.03 |
| ExM-10 | 0.015 |
| ExY-14 | 0.01 |
| Solv-1 | 0.2 |

| Ninth Layer (High Sensitive Green Sensitive Emulsion Layer) | |
|---|---|
| Silver iodobromide emulsion (AgI 6 mol %, Inner part high AgI type, Corresponding sphere diameter 1.0μ, Variation coefficient of the corresponding sphere diameter 80%, Irregular grains, Diameter/thickness ratio 1.2) | |
| Coated silver weight | 0.85 |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |

| Tenth Layer (Yellow Filter Layer) | |
|---|---|
| Gelatin | 1.2 |
| Yellow colloidal silver | 0.08 |
| Cpd-2 | 0.1 |
| Solv-1 | 0.3 |

| Eleventh Layer (Low Sensitive Blue Sensitive Emulsion Layer) | |
|---|---|
| Silver iodobromide emulsion (AgI 4 mol %, Inner part high AgI type, Corresponding sphere diameter 0.5μ, Variation coefficient of the corresonding sphere diameter 15%, Irregular grains) | |
| Coated silver weight | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |

| Twelfth Layer (High Sensitive Blue Sensitive Emulsion Layer) | |
|---|---|
| Silver iodobromide emulsion (AgI 10 mol %, Inner part high AgI type, Corresponding sphere diameter 1.3μ, Variation coefficient of the corresponding sphere diameter 25%, Irregular grains, Diameter/thickness ratio 4.5) | |
| Coated silver weight | 0.6 |
| Gelatin | 0.6 |
| ExS-9 | $1 \times 10^{-4}$ |
| ExY-16 | 0.25 |
| Solv-1 | 0.2 |

| Thirteenth Layer (First Protective Layer) | |
|---|---|
| Gelatin | 0.8 |
| UV-1 | 0.1 |
| UV-2 | 0.2 |
| Solv-1 | 0.01 |
| Solv-2 | 0.01 |

| Fourteenth Layer (Second Protective Layer) | |
|---|---|
| Fine grained silver bromide (Average grain size 0.07μ) | 0.5 |
| Gelatin | 0.45 |
| Polymethyl methacrylate grains (Diameter 1.5μ) | 0.2 |
| H-1 | 0.4 |
| Cpd-3 | 0.5 |
| Cpd-4 | 0.5 |

As well as the components indicated above the surfactant X-1 was added to each layer as a coating aid. The sample of material prepared in the way described above was sample 101.

The chemical structures or chemical names of the compounds used in the invention are indicated below.

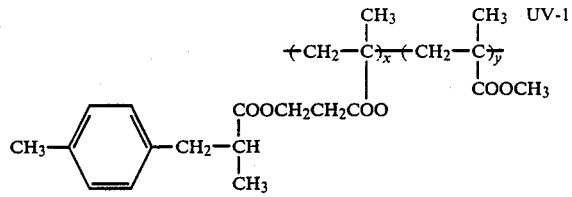

x/y = 7/3 (by weight)

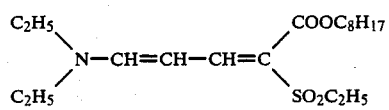

Solv-1: Triceryl phosphate
Solv-2: Dibutyl phthalate
Solv-3: Bis(2-ethylhexyl)phthalate ExM-8
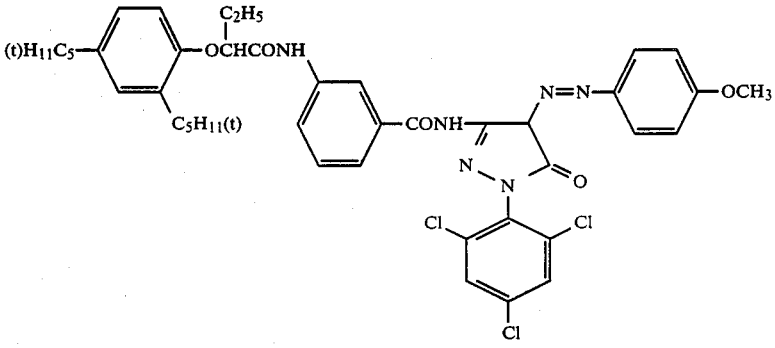
ExC-2
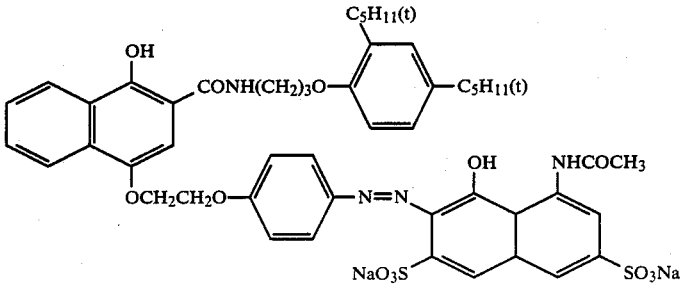
ExC-3
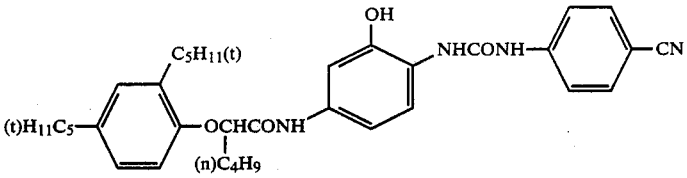
ExC-4
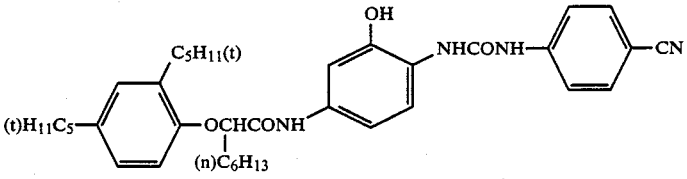
ExY-14
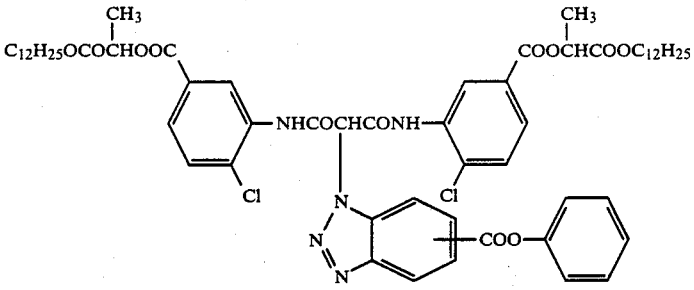
ExY-15
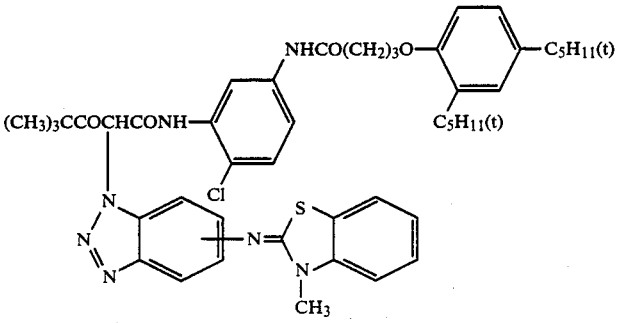

-continued
ExC-5
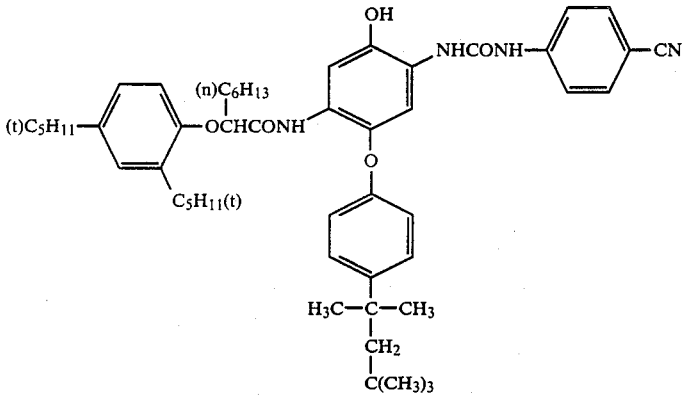
ExC-6
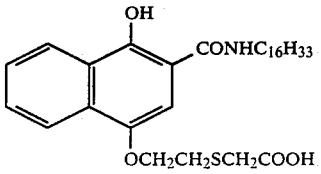
ExC-7
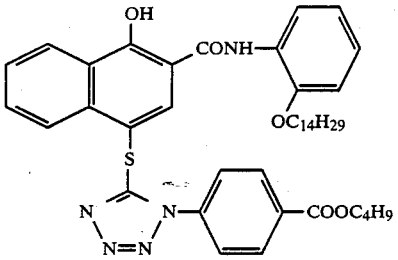
ExM-9
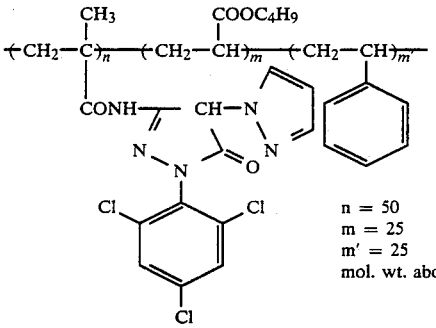
n = 50
m = 25
m' = 25
mol. wt. about 20,000
ExM-10
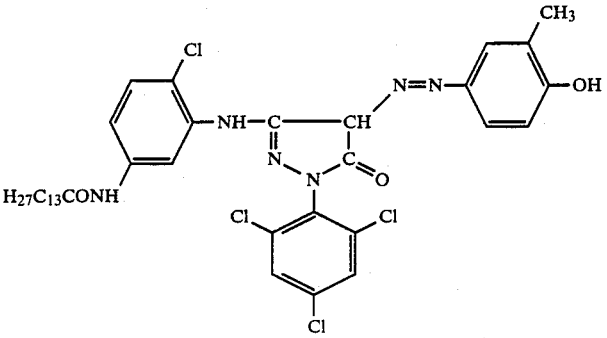

-continued
ExM-11
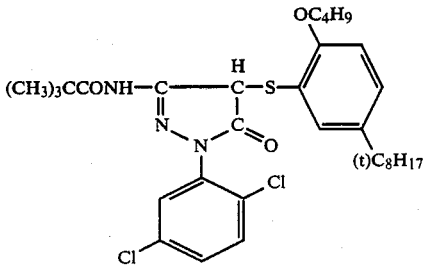
ExM-12
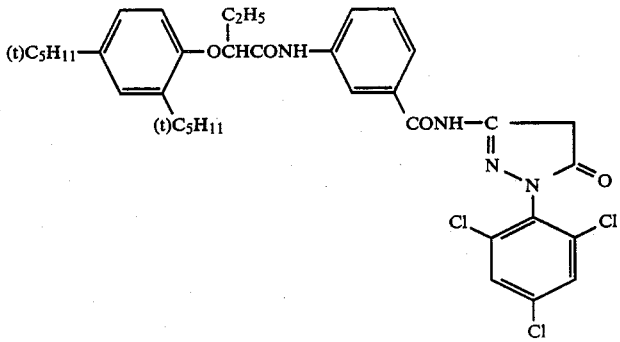
ExM-13
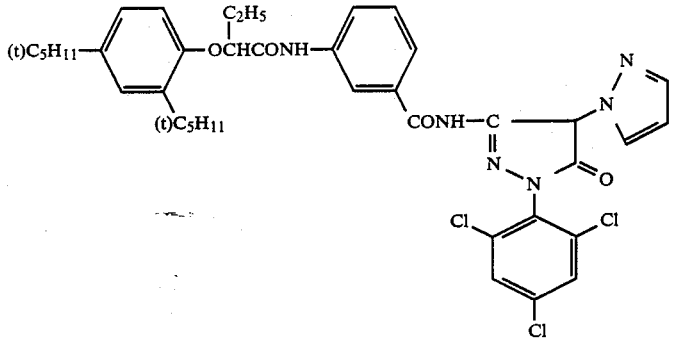
ExY-16
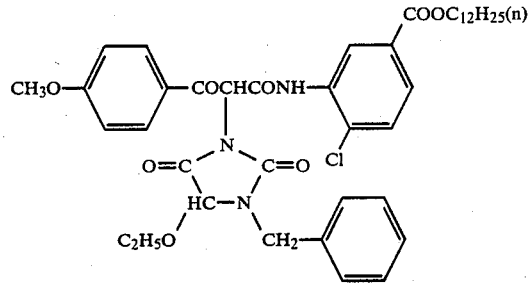
Cpd-1
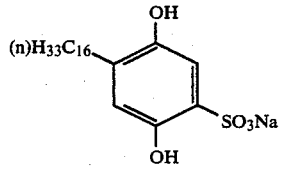
Cpd-2
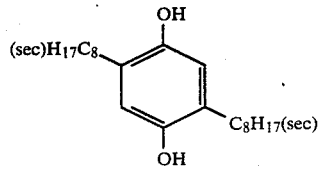

-continued
ExS-1
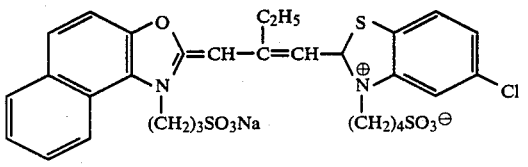
ExS-2
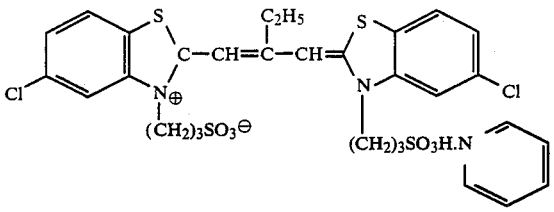
ExS-3
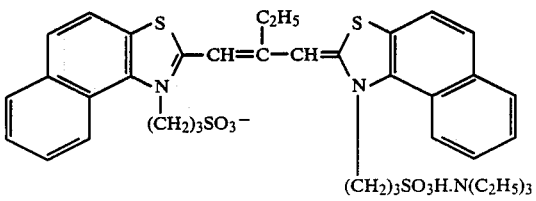
ExS-4
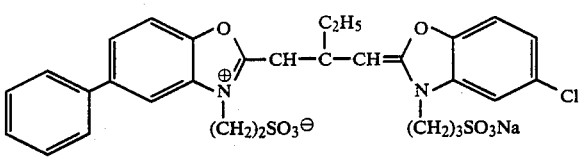
ExS-5
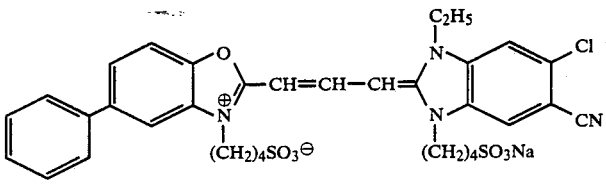
ExS-6
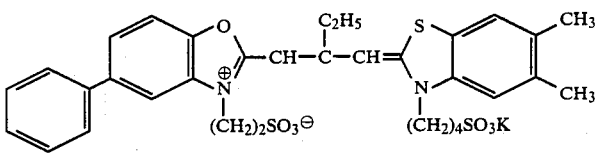
ExS-7
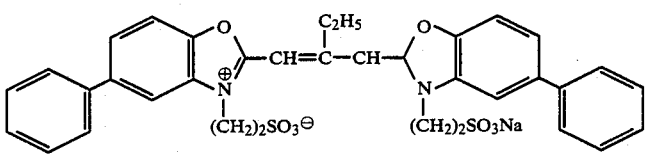
ExS-8
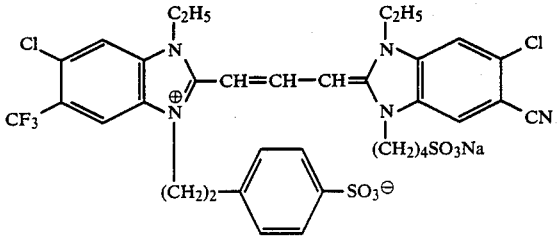

-continued

ExS-9

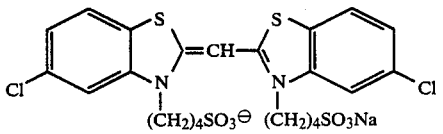

H-1

$CH_2{=}CH{-}SO_2{-}CH_2{-}CONH{-}CH_2$
$CH_2{=}CH{-}SO_2{-}CH_2{-}CONH{-}CH_2$

Cpd-3

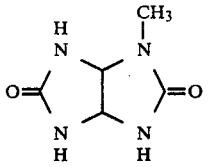

Cpd-4

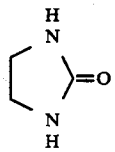

X-1

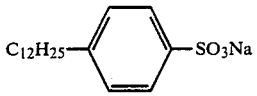

The sample prepared in the way outlined above was sample 101.

Preparation of Samples 102–117

These were prepared in the same way as sample 101, except that the couplers shown in Table 1 below were used in equimolar quantities in each case in place of the DIR coupler ExC-7 in layers 3 and 4 and the cyan coupler ExC-6 in layer 5 of sample 101.

Samples 101–117 obtained in this way were cut into strips of width 35 mm, a standard object was photographed and 500 m running tests were carried out in each case using the development process operations (I) and (II) outlined below. On completion of this running test, an exposure of 20 CMS was made in white light on each of samples 101–117 and the materials were processed using the processing operations (I) and (II) outlined below.

Comparative Coupler A

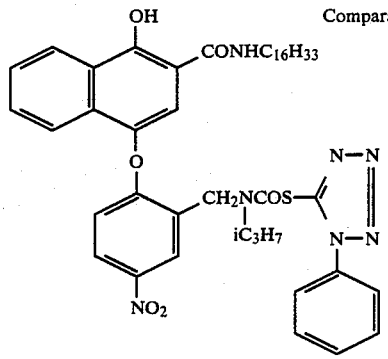

Comparative Coupler B

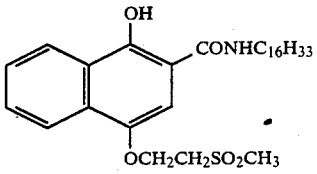

| Processing Operation (I) (Temperature 38° C.) | | |
|---|---|---|
| | Process (I) | |
| Operation | Processing Time | Replenishment* |
| Color development | 3 min. 15 sec. | 15 ml |
| Bleach | 1 min. 00 sec. | 10 ml |
| Bleach-Fix | 3 min. 15 sec. | 15 ml |
| Wash 1 | 40 sec. | |
| Wash 2 | 1 min. 00 sec. | 30 ml |
| Stabilize | 20 sec. | 15 m |
| Drying | 1 min. 15 sec. (60° C.) | |

*Replenishment rate per 1 meter of 35 mm wide material

In the processingg operation indicated above, the washes 1 and 2 consisted of a counter-flow system from wash 2 to wash 1. The compositions of the processing baths were as indicated below.

| | Main Bath (grams) | Replenisher (grams) |
|---|---|---|
| Color Developer Bath | | |
| Diethylenetriamine penta-acetic acid | 1.0 | 1.1 |
| 1-hydroxyethylidene-1, 1-disulfonic acid | 2.0 | 2.2 |
| Sodium sulfite | 4.0 | 4.9 |
| Potassium carbonate | 30.0 | 42.0 |
| Potassium bromide | 1.6 | |
| Potassium iodide | 2.0 mg | |
| Hydroxylamine | 2.4 | 3.6 |
| 4-(N—ethyl-N-β-hydroxyethyl-amino)-2-methylaniline sulfate | 5.0 | 7.3 |
| Water to make | 1 liter | 1 liter |
| pH | 10.00 | 10.05 |
| Bleach Bath (Main Bath and Replenisher) | | |
| Ethylenediamine tetra-acetic acid iron (III) ammonium salt | 120.0 grams | |
| Ethylenediamine tetra-acetic acid disodium salt | 10.0 grams | |
| Ammonium nitrate | 10.0 grams | |
| Ammonium bromide | 100.0 grams | |
| Aqueous ammonia added to obtain | pH 6.3 | |
| Water to make | 1 liter | |
| Bleach-Fix Bath (Main Bath and Replenisher) | | |
| Ethylenediamine tetra-acetic acid iron (III) ammonium salt | 50.0 grams | |
| Ethylenediamine tetra-acetic acid disodium salt | 5.0 grams | |
| Sodium sulfite | 12.0 grams | |
| Aqueous ammonia thiosulfate solution (70%) | 240 ml | |
| Aqueous ammonia added to obtain | pH 7.3 | |
| Water to make | 1 liter | |

Wash Water

Town water which had been passed through a column packed with a sodium-type strongly acidic cation exchange resin ("Diaion SK-18", made by the Mitsubishi Chemical Industries Inc.) and which has a calcium content of 2 mg/liter and a magnesium content of 1.2 mg/liter was used for the wash water.

| | Main Bath (grams) | Replenisher (grams) |
|---|---|---|
| Stabilizing Bath | | |
| Formalin (37% w/v) | 2.0 ml | 3.0 ml |
| Polyoxyethylene p-mono-nonyl-phenyl ether (average degree of polymerization 10) | 0.3 | 0.45 |
| 5-Chloro-2-methyl-4-isothiazolin-3-one | 0.03 | 0.045 |
| Water to make | 1 liter | 1 liter |

Color Developer Bath
Processing Operation (II) (Temperature 38° C.)

| Operation | Processing time | Tank Capacity | Replenishment* |
|---|---|---|---|
| Color development | 3 min. 15 sec. | 8 liters | 15 ml |
| Bleach-Fix | 2 min. 30 sec. | 8 liters | 25 ml |
| Wash 1 | 20 sec. | 4 liters | 3 stage counter |
| Wash 2 | 20 sec. | 4 liters | flow system |
| Wash 3 | 20 sec. | 4 liters | 10 ml |
| Stabilizer | 20 sec. | 4 liters | 10 ml |

*Per 1 meter of 35 mm wide photosensitive material

| | Main Bath (grams) | Replenisher (grams) |
|---|---|---|
| Color Developer Bath | | |
| Diethylenetriamine penta-acetic acid | 1.0 | 1.2 |
| 1-hydroxyethylidene-1, 1-disulfonic acid | 2.0 | 2.4 |
| Sodium sulfite | 2.0 | 4.8 |
| Potassium carbonate | 35.0 | 45.0 |
| Potassium bromide | 1.6 | |
| Potassium iodide | 2.0 mg | |
| Hydroxylamine | 2.0 | 3.6 |
| 4-(N-ethyl-N-β-hydroxyethyl-amino)-2-methylaniline sulfate | 5.0 | 7.5 |
| Water to make | 1 liter | 1 liter |
| pH (Adjusted with potassium hydroxide) | 10.20 | 10.35 |
| Bleach-Fix Bath | | |
| Ethylenediamine tetra-acetic acid iron (III) ammonium salt | 40 | 45 |
| Diethylenetriamine penta-acetic acid iron (III) ammonium salt | 40 | 45 |
| Ethylenediamine tetra-acetic acid disodium salt | 10 | 10 |
| Sodium sulfite | 15 | 20 |
| Aqueous ammonium thiosulfate solution (70% w/v) | 240 | 270 |
| Aqueous ammonia (26%) | 14 ml | 12 ml |
| Water to make | 1 liter | 1 liter |
| pH | 6.7 | 6.5 |

Wash Water

Town water was passed through a mixed bed column packed with an H-type strongly acidic cation exchange resin ("Diaion SK-1B", made by the Mitsubishi Chemical Industries Inc.) and an OH-type strongly basic anion exchange resin ("Diaion SA-10A", made by the Mitsubishi Chemical Industries Inc.) and after achieving the water quality indicated below, 20 mg/liter of sodium dichloroisocyanurate was added as a disinfectant.

| | |
|---|---|
| Calcium ion content | 1.1 mg/liter |
| Magnesium ion content | 0.5 mg/liter |
| pH | 6.9 |

Processing was carried out using the operations and processing baths described above.

The residual silver content of the developed samples so obtained was determined using fluorescent X-ray analysis.

Moreover, samples exposed through an MTF evaluation type wedge were processed in the same way as described above in order to measure the MTF values of samples 101–110. (The MTF is described on page 536 of the T. H. James, *The Theory of the Photographic Process.* 3rd. Ed. (Macmillan)).

The results obtained are shown in Table 1 below.

The results clearly show that a high degree of sharpness and a low residual silver content were only contained with the combinations of this invention.

TABLE 1

| Sample Number | DIR Coupler in Third & Fourth Layers | Coupler in Fifth Layer | Residual Silver Process I ($\mu g/cm^2$) | Residual Silver Process II ($\mu g/cm^2$) | MTF of Red Sensitive layer (Process I) (20 cycles/mm) |
|---|---|---|---|---|---|
| 101 (Comparison) | ExC-7 | ExC-6 | 21 | 43 | 0.45 |
| 102 (Comparison) | — | " | 18 | 32 | 0.36 |
| 103 (Comparison) | A | " | 23 | 42 | 0.46 |
| 104 (Comparison) | ExC-7 | B | 22 | 41 | 0.42 |
| 105 (Comparison) | A | " | 23 | 43 | 0.40 |
| 106 (Comparison) | D-14 | ExC-6 | 37 | 62 | 0.51 |
| 107 (Comparison) | D-13 | " | 38 | 67 | 0.51 |
| 108 (Comparison) | ExC-7 | E-7 | 4 | 8 | 0.46 |
| 109 (Comparison) | " | E-9 | 5 | 9 | 0.47 |
| 110 (Comparison) | " | E-18 | 4 | 7 | 0.44 |
| 111 (Comparison) | " | E-37 | 4 | 8 | 0.46 |
| 112 (Invention) | D-14 | E-7 | 3 | 7 | 0.55 |
| 113 (Invention) | " | E-9 | 3 | 7 | 0.56 |
| 114 (Invention) | " | E-18 | 2 | 8 | 0.57 |
| 115 (Invention) | " | E-37 | 2 | 7 | 0.54 |
| 116 (Invention) | D-13 | E-18 | 2 | 6 | 0.55 |
| 117 (Invention) | " | E-37 | 2 | 6 | 0.56 |

EXAMPLE 2

A running process was carried out with samples 101–117 used in Example 1 in the same way as in Example 1, except that the rinse bath described below was used in place of the wash bath in Processing Operation (II). The results obtained were the same as those obtained in Example 1.

| Rinse Bath | |
|---|---|
| Town water | |
| Calcium | 26 mg/liter |
| Magnesium | 9 mg/liter |
| Ethylenediamine tetra-acetic acid disodium salt | 500 mg/liter |
| pH | 6.7 |

EXAMPLE 3

Running processing as in Example 2 was carried out using the stabilizing bath indicated below in place of the rinse bath used in Example 2 and the residual silver contents and MTF values were investigated. The results obtained were the same as those obtained in Example 1.

Moreover, the processed samples obtained in Examples 1 and 3 were stored for 4 weeks under conditions of 80° C., 70% relative humidity (RH) and the image storage properties were investigated. The results obtained indicated that the samples obtained in Example 3 had better image storage properties.

| Stabilizer Bath | Main Bath |
|---|---|
| 1-Hydroxyethylidene-1,1'-disulfonic acid (60%) | 1.6 ml |
| Bismuth chloride | 0.35 gram |
| Polyvinyl pyrrolidone | 0.25 gram |
| Aqueous ammonia | 2.5 ml |
| Nitrilo tri-acetic acid trisodium salt | 1.0 gram |
| 5-Chloro-2-methyl-4-isothiazolin-3-one | 50 mg |
| 2-Octyl-4-isothiazolin-3-one | 50 mg |
| Water to make | 1 liter |
| pH | 7.5 |

The pH was adjusted using potassium hydroxide or hydrochloric acid.

EXAMPLE 4

A multi-layer photosensitive material consisting of layers of which the composition were as indicated below on a similar support to that used in Example 1 was prepared as sample 201.

| | |
|---|---|
| **First Layer (Anti-halation Layer)** | |
| Black colloidal silver | 0.2 |
| Gelatin | 1.0 |
| Ultraviolet absorber UV-1 | 0.2 |
| High boiling point organic solvent OIL-1 | 0.02 |
| **Second Layer (Intermediate Layer)** | |
| Fine grained silver bromide (average grain diameter 0.07$\mu$) | 0.15 |
| Gelatin | 1.0 |
| **Third Layer (Low Sensitive Red Sensitive Emulsion Layer)** | |
| Silver iodobromide emulsion (silver iodide content 2 mol %, average grain size 0.3$\mu$) | 1.5 |
| Gelatin | 0.9 |
| Sensitizing dye A | $1.0 \times 10^{-4}$ |
| Sensitizing dye B | $2.0 \times 10^{-4}$ |
| Coupler D'-1 | 0.6 |
| Coupler D'-2 | 0.2 |
| Coupler D'-3 | 0.03 |
| High boiling point organic solvent OIL-1 | 0.1 |

-continued

| | |
|---|---|
| High boiling point organic solvent OIL-2 | 0.1 |

Fourth Layer
(High Sensitive Red Sensitive Emulsion Layer)

| | |
|---|---|
| Mono-dispersed silver iodobromide emulsion (silver iodide content 5 mol %, average grain size 0.7μ) | 1.2 |
| Gelatin | 1.0 |
| Sensitizing dye A | $3.0 \times 10^{-4}$ |
| Sensitizing dye B | $2.0 \times 10^{-4}$ |
| Coupler D'-1 | 0.01 |
| Coupler D'-2 | 0.03 |
| Coupler D'-5 | 0.06 |
| Coupler D'-3 | 0.02 |
| High boiling point organic solvent OIL-2 | 0.1 |

Fifth Layer (Intermediate Layer)

| | |
|---|---|
| Gelatin | 1.0 |
| Compound Cpd-A | 0.05 |
| High boiling point organic solvent OIL-2 | 0.05 |

Sixth Layer
(Low Sensitive Green Sensitive Emulsion Layer)

| | |
|---|---|
| Mono-dispersed silver iodobromide emulsion (silver iodide content 3 mol %, average grain size 0.3μ) | 0.6 |
| Mono-dispersed silver iodobromide emulsion (silver iodide content 6 mol %, average grain size 0.5μ) | 0.7 |
| Gelatin | 1.0 |
| Sensitizing dye C | $3.0 \times 10^{-4}$ |
| Sensitizing dye D | $2.0 \times 10^{-4}$ |
| Coupler D'-6 | 0.4 |
| Coupler D'-7 | 0.1 |
| Coupler D'-8 | 0.02 |
| Coupler D'-9 | 0.01 |
| High boiling point organic solvent OIL-2 | 0.05 |

Seventh Layer
(High Sensitive Green Sensitive Layer)

| | |
|---|---|
| Poly-dispersed silver iodobromide emulsion (silver iodide content 7 mol %, average grain size 0.8μ) | 0.8 |
| Gelatin | 0.9 |
| Sensitizing dye C | $2 \times 10^{-4}$ |
| Sensitizing dye D | $1.5 \times 10^{-4}$ |
| Coupler D'-6 | 0.08 |
| Coupler D'-7 | 0.05 |
| Coupler D'-9 | 0.02 |
| High boiling point organic solvent OIL-1 | 0.08 |
| High boiling point organic solvent OIL-2 | 0.03 |

Eighth Layer (Intermediate Layer)

| | |
|---|---|
| Gelatin | 1.2 |

-continued

| | |
|---|---|
| Compound Cpd-A | 0.6 |
| High boiling point organic solvent OIL-1 | 0.3 |

Ninth Layer (Yellow Filter Layer)

| | |
|---|---|
| Yellow colloidal silver | 0.1 |
| Gelatin | 0.8 |
| Compound Cpd-A | 0.2 |
| High boiling point organic solvent OIL-1 | 0.1 |

Tenth Layer
(Low Sensitive Blue Sensitive Emulsion Layer)

| | |
|---|---|
| Mono-dispersed silver iodobromide emulsion (silver iodide content 6 mol %, average grain size 0.3μ) | 0.3 |
| Mono-dispersed silver iodobromide emulsion (silver iodide content 5 mol %, average grain size 0.6μ) | 0.3 |
| Gelatin | 1.0 |
| Sensitizing dye E | $1 \times 10^{-4}$ |
| Sensitizing dye F | $1 \times 10^{-4}$ |
| Coupler D'-10 | 0.9 |
| Coupler D'-4 | 0.05 |
| High boiling point organic solvent OIL-3 | 0.01 |

Eleventh Layer
(High Sensitive Blue Sensitive Emulsion Layer)

| | |
|---|---|
| Mono-dispersed silver iodobromide emulsion (silver iodide content 8 mol %, average grain size 1.5μ) | 0.7 |
| Gelatin | 0.5 |
| Sensitizing dye E | $5 \times 10^{-4}$ |
| Sensitizing dye F | $5 \times 10^{-4}$ |
| Coupler D'-10 | 0.2 |
| Coupler D'-4 | 0.05 |
| High boiling point organic solvent OIL-3 | 0.01 |

Twelfth Layer (First Protective Layer)

| | |
|---|---|
| Gelatin | 0.5 |
| Fine grained silver bromide emulsion (average grain size 0.07μ) | 0.33 |
| Coupler D'-11 | 0.1 |
| Ultraviolet absorber UV-2 | 0.1 |
| Ultraviolet absorber UV-3 | 0.2 |
| High boiling point organic solvent OIL-4 | 0.01 |

Thirteenth Layer (Second Protective Layer)

| | |
|---|---|
| Gelatin | 0.8 |
| Polymethyl methacrylate grains (average size 1.5μ) | 0.2 |
| Formaldehyde scavenger S-1 | 0.5 |

The surfactant W-1 and the film hardener H'-1 were also added.

Coupler D'-1

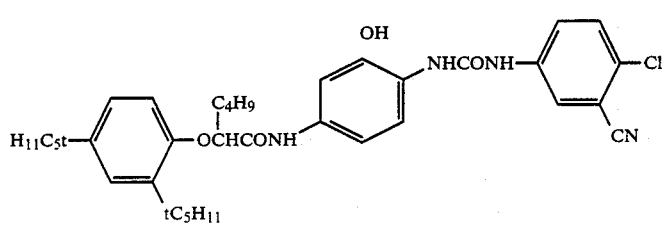

-continued
Coupler D'-2
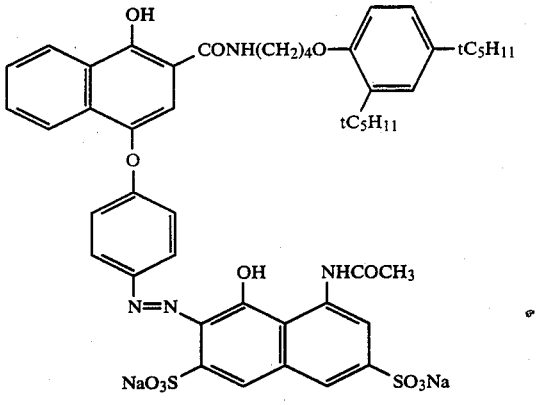
Coupler D'-3
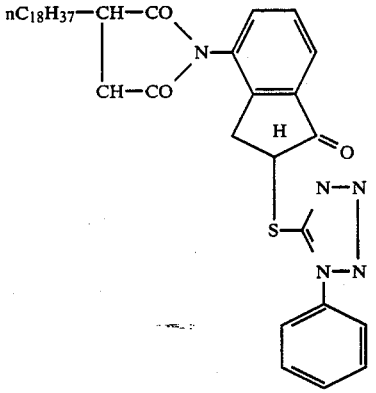
Coupler D'-5
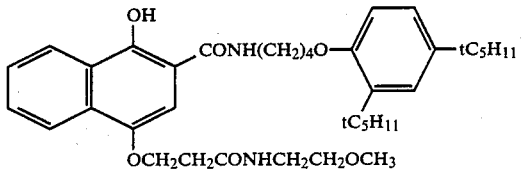
Coupler D'-6
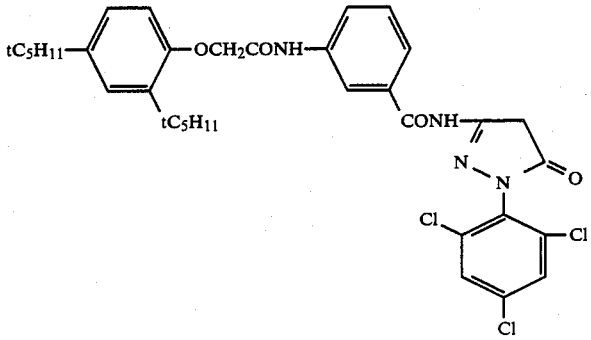

-continued
Coupler D'-7
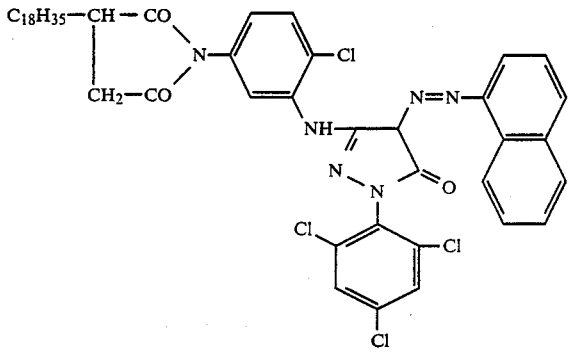
Coupler D'-8
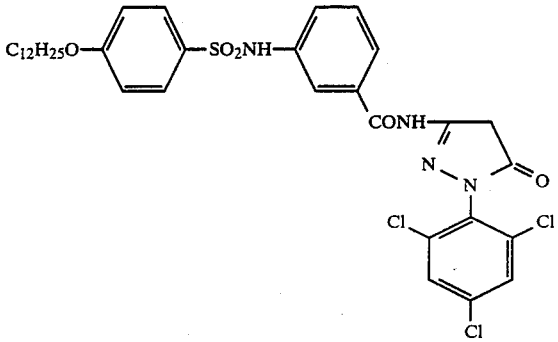
Coupler D'-4
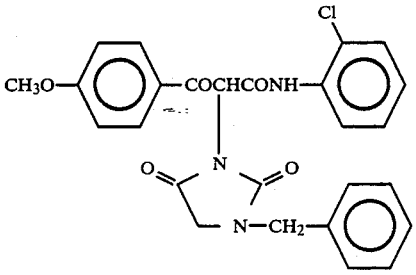
Coupler D'-9
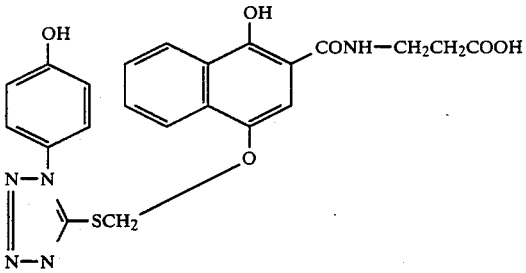
Coupler D'-10
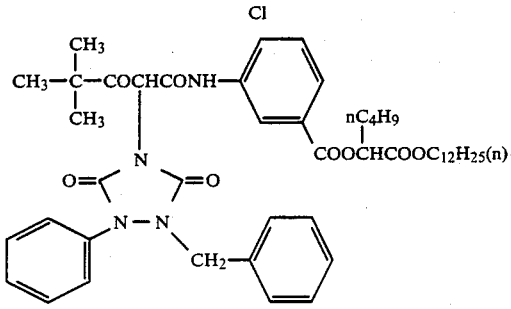

-continued
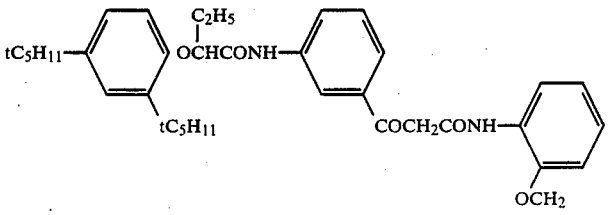
Coupler D'-11
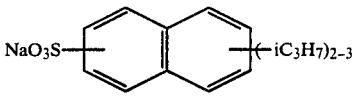
Surfactant W-1
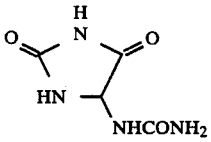
Formaldehyde Scavenger S-1
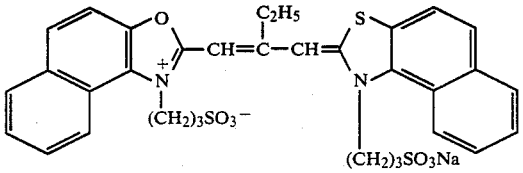
Sensitizing Dye A
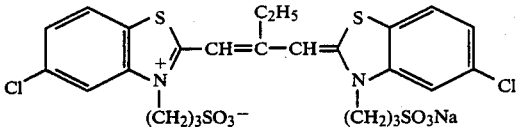
Sensitizing Dye B
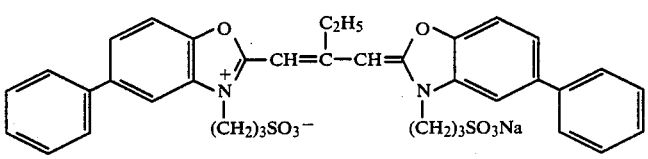
Sensitizing Dye C
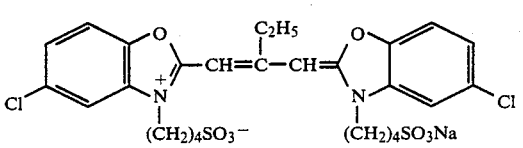
Sensitizing Dye D
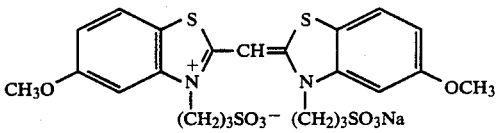
Sensitizing Dye E
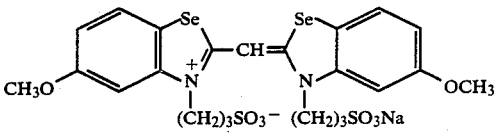
Sensitizing Dye F
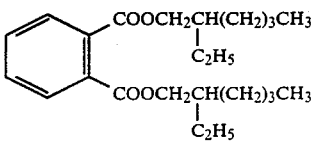
High Boiling Point Organic Solvent OIL-1

-continued

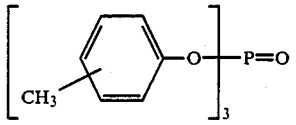

High Boiling Point Organic Solvent OIL-2

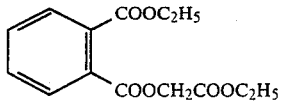

High Boiling Point Organic Solvent OIL-3

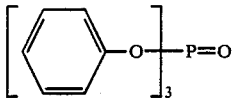

High Boiling Point Organic Solvent OIL-4

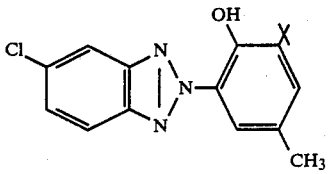

Ultraviolet Absorber UV-1

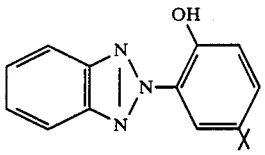

Ultravilet Absorber UV-2

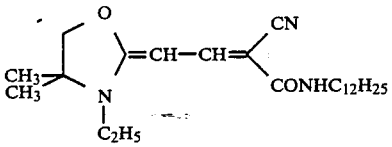

Ultravilet Absorber UV-3

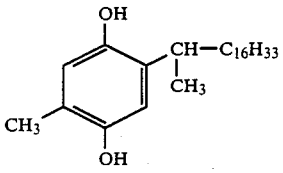

Compound Cpd-A

Film Hardening Agent H'-1
$CH_2{=}CHSO_2(CH_2)_3SO_2CH{=}CH_2$

Preparation of Samples 201–217

These were prepared in the same way as sample 201, except that the coupler D'-3 and D'-5 in the third and fourth layers of sample 201 were modified in the way shown in Table 2, and the surfactant W-1 was modified as shown in Table 2 using the surfactant X-1.

The residual silver contents, MTF values and the image storage properties of samples 201–217 obtained in this way were investigated after running processing in the same way as in Example 3 using the same processing operation.

TABLE 2

| Sample Number | DIR Coupler in Layers 3 and 4 | Coupler in Layer 4 | Surfactant |
|---|---|---|---|
| 201 (Comparison) | D'-3 | D'-5 | W-1 |
| 202 (Comparison) | A | D'-5 | " |
| 203 (Comparison) | D'-3 | E-7 | " |
| 204 (Invention) | D-14 | " | " |
| 205 (Invention) | D-13 | " | " |

TABLE 2-continued

| Sample Number | DIR Coupler in Layers 3 and 4 | Coupler in Layer 4 | Surfactant |
|---|---|---|---|
| 206 (Invention) | " | E-18 | " |
| 207 (Invention) | " | E-12 | " |
| 208 (Invention) | D-21 | E-37 | " |
| 209 (Comparison) | D'-3 | D'-5 | X-1 |
| 210 (Comparison) | A | D'-5 | " |
| 211 (Comparison) | D'-3 | E-7 | " |
| 212 (Invention) | D'-14 | " | " |
| 213 (Invention) | D'-13 | " | " |
| 214 (Invention) | " | D'-13 | " |
| 215 (Invention) | " | E-18 | " |
| 217 (Invention) | D'-21 | E-12 | " |
| | | E-37 | " |

The results obtained show that, as in the case of Table 1, the best residual silver and MTF values were obtained using the combinations of this invention, but the image storage properties were better when the surfactant W-1 was used rather than X-1, the color fastness of the cyan, magenta and yellow images being higher in this case.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one silver halide emulsion layer on a support wherein, at least one type of development inhibitor releasing type coupler is present which, by means of a coupling reaction with the oxidized form of a primary aromatic amine developing agent, releases a precursor of a compound, the precursor inhibiting the development of silver halide which subsequently, by means of an electron transfer reaction via an ethylenic conjugated chain, releases a compound which inhibits the development of silver halide, and at least one type of bleach accelerating agent releasing type coupler is present which, by means of a coupling reaction with the oxidized form of a primary aromatic amine developing agent, releases a bleach accelerating agent or a precursor thereof.

2. A silver halide color photographic material as in claim 1, wherein the bleach accelerating agent releasing type coupler is represented by formula [I], [II], [III] or [IV]:

Formula [I]

$A—(Time)_n—S—R_1—R_2$

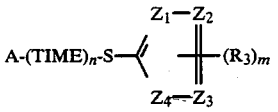

Formula [III]

$A—(Time)_n—S—R_4(R_3)_m$

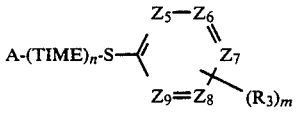

wherein A represents the coupler residual group, TIME represents a timing group, n is an integer of value 0 or 1, $Z_1$, $Z_2$ and $Z_3$ each independently represent a nitrogen atom or a methine group, $Z_4$ represents an oxygen atom, a sulfur atom or an imino group, $Z_5$, $Z_6$, $Z_7$, $Z_8$ and $Z_9$ each independently represents a nitrogen atom, or a methine group, except that at least one of $Z_5$, $Z_6$, $Z_7$, $Z_8$ and $Z_9$ represents a nitrogen atom, $R_1$ represents a divalent aliphatic group which has from 1 to 8 carbon atoms or an aromatic group which has from 6 to 10 carbon atoms, $R_2$ represents a water soluble substituent group, $R_3$ represents a water soluble substituent group, m is an integer of value from 0 to 2 and $R_4$ is an alicyclic group which has from 3 to 10 carbon atoms or a saturated heterocyclic group which has from 3 to 10 carbon atoms.

3. A silver halide color photographic material as in claim 2, wherein $R_2$ and $R_3$ have not more than 8 carbon atoms and contain at least one group from among carboxyl groups, sulfo groups, hydroxyl group, substituted or unsubstituted amino groups, acyl groups, alkoxy groups, acylamino groups, sulfonamido groups, sulfamoyl groups, carbamoyl groups, ureido groups, alkylthio groups or sulfonyl groups as substituent groups.

4. A silver halide color photographic material as in claim 3, wherein $R_2$ and $R_3$ contain at least one group which has a $\pi$-substituent constant of less than 0.5.

5. A silver halide color photographic material as in claim 1, wherein the development inhibitor releasing type couplers are represented by formula (V):

Formula (V)

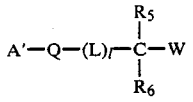

wherein A' represents a coupler residual group which releases the remaining section of the molecule including Q on undergoing a coupling reaction with the oxidized form of a primary aromatic amine developing agent, Q represents an oxygen atom, sulfur atom or a substituted imino group, L represents a vinylene group, l is an integer of value 1 or 2, $R_5$ and $R_6$ each independently represent a hydrogen atom, an alkyl group or an aryl group and W represents a component which inhibits the development of silver halide.

6. A silver halide color photographic material as in claim 5, wherein when Q represents a substituted imino group, the substituent is linked with L and forms together with the nitrogen atom and L a five- to seven-membered nitrogen-containing ring.

7. A silver halide color photographic material as in claim 5, wherein the development inhibitor releasing type couplers are represented by formulae (VI)–(IX):

Formula (VI)

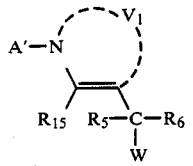

Formula (VII)

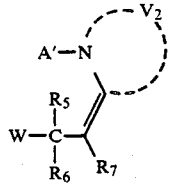

Formula (VIII)

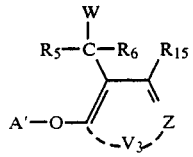

Formula (IX)

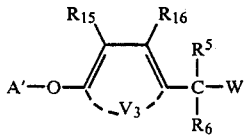

wherein A', $R_5$, $R_6$ and W have the same significance as A', $R_5$, $R_6$ and W in general formula (V) and $V_1$ and $V_2$ represent non-metallic atomic groups which are required to form, along with the linked atomic groups, a five- to seven-membered nitrogen-containing heterocyclic ring and $V_3$ represents a non-metallic atomic group which is required to form, along with the linked atomic groups, a five- to seven-membered heterocyclic ring or a benzene ring, Z represents a substituted or unsubstituted methine group or a nitrogen atom, $R_7$ represents a hydrogen atom, a univalent group or is linked to $V_2$ to form a ring and $R_{15}$ and $R_{16}$ each independently represent a univalent group.

8. A silver halide color photographic material as in claim 1, wherein the development inhibitor releasing type coupler is present in an amount of from $1\times10^{-5}$ mol % to $1\times10^{-1}$ mol % with respect to the total amount of silver coated and the bleach accelerating agent releasing coupler is present in an amount of from 0.01 mol % to 100 mol % with respect to the total amount of silver coated.

* * * * *